US006309164B1

(12) United States Patent
Holder et al.

(10) Patent No.: US 6,309,164 B1
(45) Date of Patent: Oct. 30, 2001

(54) METHOD AND APPARATUS FOR COLLECTING RECYCLABLE MATERIALS

(75) Inventors: Jamie Val Holder, Bay Springs; Stephen Bryan Adkins, Laurel; Robert William Fallon, Hattisburg, all of MS (US)

(73) Assignee: Hol-Mac Corporation, Bay Springs, MI (US)

( * ) Notice: Subject to any disclaimer, the term of this patent is extended or adjusted under 35 U.S.C. 154(b) by 0 days.

(21) Appl. No.: 09/325,741

(22) Filed: Jun. 4, 1999

(51) Int. Cl.[7] ..... B65F 3/12
(52) U.S. Cl. ..... 414/399; 414/406; 414/420
(58) Field of Search ..... 414/389, 396, 414/397, 399, 402, 406, 407, 408, 409, 420, 572, 584

(56) References Cited

U.S. PATENT DOCUMENTS

| | | | | |
|---|---|---|---|---|
| 3,679,078 | * | 7/1972 | Wetzel | 414/406 X |
| 3,870,174 | * | 3/1975 | Brisson | 414/408 |
| 4,200,330 | * | 4/1980 | Scott | 414/407 X |
| 4,210,407 | * | 7/1980 | Broyhill et al. | 414/407 |
| 4,859,135 | * | 8/1989 | Neufeldt | 414/399 X |
| 5,215,423 | * | 6/1993 | Schulte-Hinsken et al. | 414/408 |
| 5,338,140 | * | 8/1994 | Elkdahl et al. | 414/397 X |
| 5,413,448 | * | 5/1995 | Peshkin | 414/406 X |
| 6,077,020 | * | 6/2000 | Neufeldt et al. | 414/399 |
| 6,120,052 | * | 9/2000 | Capik et al. | 280/477 |

* cited by examiner

*Primary Examiner*—James W. Keenan
(74) *Attorney, Agent, or Firm*—Ronald E. Greigg; Edwin E. Greigg

(57) ABSTRACT

The invention provides a refuse and recyclable materials collection system which includes a self-dumping bin, a hauling unit with a tailgate and an opening top, side or both, a compacting ram that empties the hopper into the body, compacts and ejects the collected materials. The collection vehicle is placed into a loading position, which can be on either side of the vehicle. For collection of two different types of recyclable materials the collection vehicle can be equipped with two receiving doors, hoppers, rams, compacting chambers and tailgates. The self-dumping bin receives power by connecting hydraulic lines from the collection vehicle. The self-dumping bin is then raised to the dumping position by a lifting mechanism. The receiving door opens to form a chute for receiving the materials from the self-dumping bin. A baffle on each of the receiving doors forms a trap to prevent spillage. The bin has a tapered "lip" that funnels the material into the hopper of the hauling unit. The bin is moved into a tipping position allowing the materials to empty from the bin into the hopper of the collection vehicle. As the hopper is filled the ram manually or automatically cycles to empty the hopper and compact the material. The loaded vehicle is then transported to either a landfill for refuse or a material recycling facility for recycling. The collection vehicle can be a trailer, which is towed by a truck or a body mounted on a truck chassis.

14 Claims, 22 Drawing Sheets

9B

9A 122
521
520
170
270
522
350
110
360
364
361
363
362
490
500
340
510

121
521
520
110
340
270
170
350
522
510
500
490
360
361
363
362
364

14B

14A

16B

16A

16D

16C

16F

16E

17B

17A

17D

17C

17F

17E

METHOD AND APPARATUS FOR COLLECTING RECYCLABLE MATERIALS

BACKGROUND OF THE INVENTION

1. Field of the Invention

This invention relates to improvements in refuse and recycling systems. More specifically, the inventive system involves a self-dumping bin, which unloads material into a hauling unit, whereupon the material can be compacted for hauling purposes.

2. Prior Art

The collection and removal of solid waste is a major municipal problem. For example, residential refuse is generated at an average rate of approximately 2.5 pounds per day per capita. As accumulated, loose and uncompacted, the refuse has a density generally in the range of 150 to 250 pounds per cubic yard. For the well being of the community, removal of refuse is imperative.

Traditionally, recycling and residential refuse, including garbage, trash, and other waste materials are usually stored in containers of approximately 10 to 30 gallon capacity. Once or twice a week, the containers are placed at curbside for a scheduled collection. Containers weigh approximately 75 to 100 pounds. Commercial or industrial facilities accumulate waste in larger, heavier containers.

Conventionally, these refuse containers are emptied into a refuse collection vehicle, which transports the material to a disposal site. Disposal sites could be landfills, dumps or incinerators. The conventional refuse collection method involves a mechanized unit and manual labor. A crew of three or more attended the vehicle. One of the crew, the driver, tends to the everyday operation of the vehicle, while others bring the refuse to the vehicle. The vehicle includes a hopper with a low loading height into which the collectors empty the containers.

Considerable effort has been devoted to developing devices, which increase the speed, and efficiency of refuse collected. The current efforts are directed towards automation of the collection process. These self loading devices engage, lift, and dump refuse containers into the collection vehicle. The self-loading devices include side or rear mounted arms and front loading arms. The use of such devices has increased the rate of collection.

While many improvements have greatly increased the rate at which refuse is collected, they fail to address pressing problems generated by the increasing population and the expenses related to constructing and operating disposal sites. Americans generate over 300 million tons of solid waste a year. The national recycling effort only consists of approximately 100 million tons per year, or 30%, which leaves 200 million tons of disposal entering into landfills. Recycling programs are the most logical solution to control the amount of material entering into disposal sites. In return, these programs will help decrease the cost of operating landfills and generate materials for future products such as recycled paper, plastic and glass etc.

The largest cost of recycling and refuse disposal is collecting and transporting. Curbside collection has been a growing trend. In less than a decade, the US has gone from approximately 1,000 curbside programs to over 9,000 programs. However, curbside collection is inherently inefficient. The reasons for this inefficiency are due to the transporting of source-separated raw materials and the intense labor required to collect and to separate materials at the curbside or a collection site.

Inventors are attempting to develop a system that will reduce the collection and transportation of recyclable materials. This invention could also be used for refuse collection in certain situations. One major problem is the complex and sophisticated loading devices mounted onto the hauling units, which are functional only 30% of the collection process. Another major problem is the lack of equipment which can collect, compact and transport recyclable materials without a loading device on the collection vehicles.

One method of reducing the cost of recycling is to strategically locate self-dumping bins for each type of recyclable material. These bins are located at what is generally called depot stations. These depots are normally located in heavily traveled areas in the community with ease and safe access such as shopping malls or roadside parks.

This type system has been in operation for several years. The Haul-All Company, located in Lethbridge, Alberta Canada, has a bin called the Hyd-A-Way. The Hyd-A-Way is a hydraulic dumping container, which operates with several truck models. The Hyd-A-Way containers (bins) range from 2 cubic yards to 6 cubic yards. The 6 cubic yard bins are normally preferred because of the holding capacity, which allows for fewer dumps into the hauling unit.

There are several inefficiencies with this system. The trucks, which range from 12 cubic yards to 21 cubic yards of hauling capacity, load material with a side hopper which is approximately 1½ cubic yards. This causes the bin to dump into the hopper approximately 4 to 8 times depending on the type and quantity of materials in the bin. Each time this process takes place it has an opportunity for spillage by over filling the hopper or wind blowing small materials thus causing litter problems which workers must pick up.

In an effort not to spill the material the operator attempts to tip the bin just enough to get the material to slide into the hopper. This not only slows the process, but sometimes the material might hang on the lid of the bin. In an attempt to avoid a large amount of material breaking loose all at one time, the operator may take a shaft with a hook on the end and try to loosen the jammed materials. This causes an unsafe operation and could cause the operator to be injured. Another inefficiency of this system is the hauling units receive a very low compaction ratio, which causes more frequent trips from the depots to the recycling materials facility.

A new hauling unit is now being used that allows for higher compaction of the materials, but the transfer process from the bins to the side hopper have the same inefficiencies previously discussed. The hopper is slightly larger which will reduce the number of times the bins are tipped, approximately 3 to 6 times depending on the type and quantity of materials. The compaction of this equipment requires a very large and expensive truck and is not very efficient when used for refuse collection.

ADDITIONAL COMMENTS FOR PRIOR ART

Concerning the Hyd-A-Way bins, much skill is required when dumping the bin into the side hopper of the truck. If the operator is not careful when he tips the bin he can over tip the bin allowing the material to break loose, overfilling the hopper and spilling onto the ground.

Furthermore, the driver of the truck has to be skilled to position the truck for receiving the material from the bin. In some cases the driver has to be flagged into position by a fellow worker in order to get into the receiving position. Not being positioned properly, too far away or too close may cause problems when transferring the materials from the bin to the hopper of the hauling unit. The latest and most improved hauling unit, the Aug-Pac manufactured by Haul-All, is harder to position than the conventional hauling unit because of its narrower hopper. When out of position and not recognized by the operator, the bin in a tipped position may cause damage to the hopper and/or the Hyd-A-Way bins.

It would be highly advantageous, therefore, to remedy the foregoing and other deficiencies in the prior art.

OBJECTS OF THE INVENTION

Accordingly, it is a principal object of the present invention to provide a recycling collection system that reduces the amount of material being disposed of into landfills.

Another object of the present invention is to reduce recycling collection costs by having consumers bring recyclable materials to strategically placed bins that are enclosed and tamper proof from animals.

An additional object of the present invention is to raise and transfer material from a self-dumping bin into the collection vehicle in a safe and timely manner.

And still another object is to dump the material from the self-dumping bin into the hopper one time.

Yet another object of the present invention is to transport materials at an optimal compaction ratio for specific materials.

Another object is to minimize the spillage of recyclable materials during a bin-to-truck transfer process.

Still another object is to allow the collection vehicle to serve as a centralized collection bin in high volume areas.

SUMMARY OF INVENTION

Briefly, to achieve the desired objects of the instant invention in accordance with a preferred embodiment thereof, provided is a refuse and recyclable materials collection system which includes a self-dumping bin, a hauling unit with a tailgate and an opening top, side or both, a compacting ram that empties the hopper into the body, compacts and ejects the collected materials. The collection vehicle is placed into a loading position which can be either side of the vehicle. For collection of two different types of recyclable materials the collection vehicle can be equipped with two receiving doors, hoppers, rams, compacting chambers and tailgates. The self-dumping bin receives power by connecting hydraulic lines from the collection vehicle. The self-dumping bin is then raised to the dumping position by a lifting mechanism. The receiving door opens to form a chute for receiving the materials from the self-dumping bin. A baffle on each of the receiving door forms a trap to prevent spillage. The bin has a tapered "lip" that funnels the material into the hopper of the hauling unit. This "lip" decreases the length of the hopper, therefore increasing the hauling capacity without increasing the overall length of the hauling unit. The bin is moved into a tipping position allowing the materials to empty from the bin into the hopper of the collection vehicle. As the bin tips, the lid of the bin opens on each end. This lip forms a chute for funneling the material from the bin through the "lip" into the chute formed by the opening of the door or doors of the hauling unit. As the hopper is filled the ram manually or automatically cycles to empty the hopper and compact the material. The loaded vehicle is then transported to either a landfill for refuse or a material recycling facility for recycling.

The collection vehicle can be a trailer, which is towed by a truck or a body mounted on a truck chassis. The complete collection system can be powered by the power take off of the tow vehicle or by an alternate power source mounted on the vehicle. When the unit is mounted on a trailer and equipped with an alternate power source, lower side loading doors can serve as a collection unit at a depot station that receives large volumes of materials.

DETAILED DESCRIPTION OF THE PREFERRED EMBODIMENTS

Figure 1A:
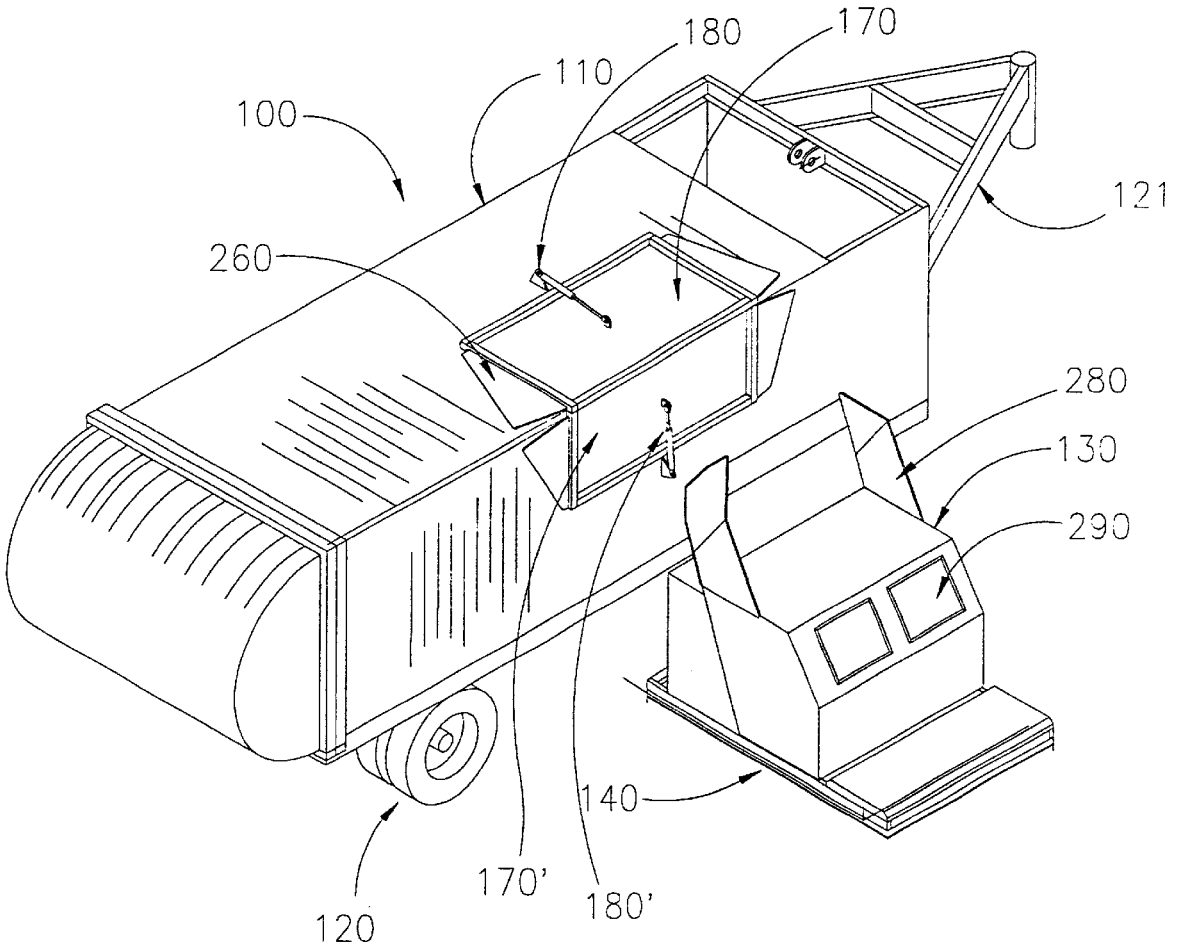
FIG. 1A is a perspective view of a collection and hauling system consisting of a self-dumping bin and a trailer type hauling unit constructed in accordance with the teaching of the instant invention.
Figure 1B:
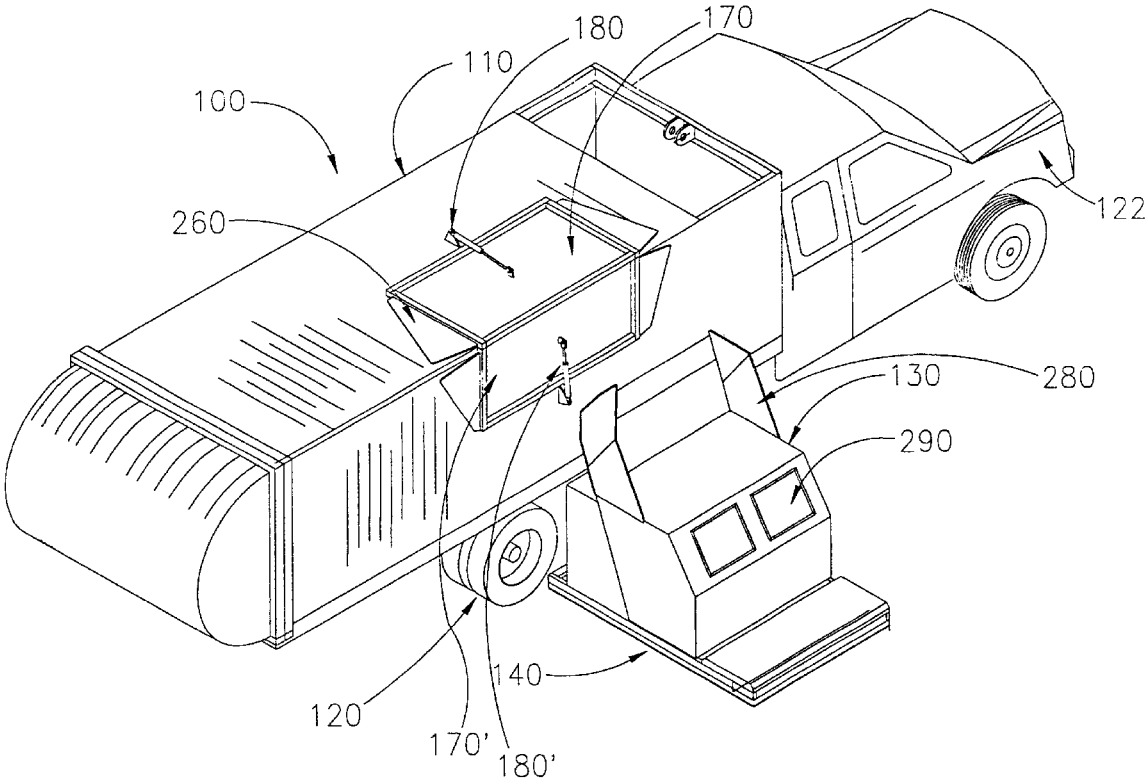
FIG. 1B is a perspective view of a collection and hauling system following the invention consisting of a self-dumping bin and a truck chassis.

Referring to FIGS. 1A and 1B, these drawings show a perspective view of the invention, generally identified as 100. This system 100 has a hauling unit 110 mounted on a transporting vehicle, generally referred to as 120. The transporting vehicle can be either a trailer 121 or a truck chassis 122. The hauling unit 110 is located adjacent to, and at the proper location in relation to the self-dumping bin 130, so that bin 130 can be unloaded into the hauling unit 110. The self-dumping bin 130 is mounted on lift mechanism 140. The details of this invention will be expanded on in FIGS. 2 through 17.

Figure 2:
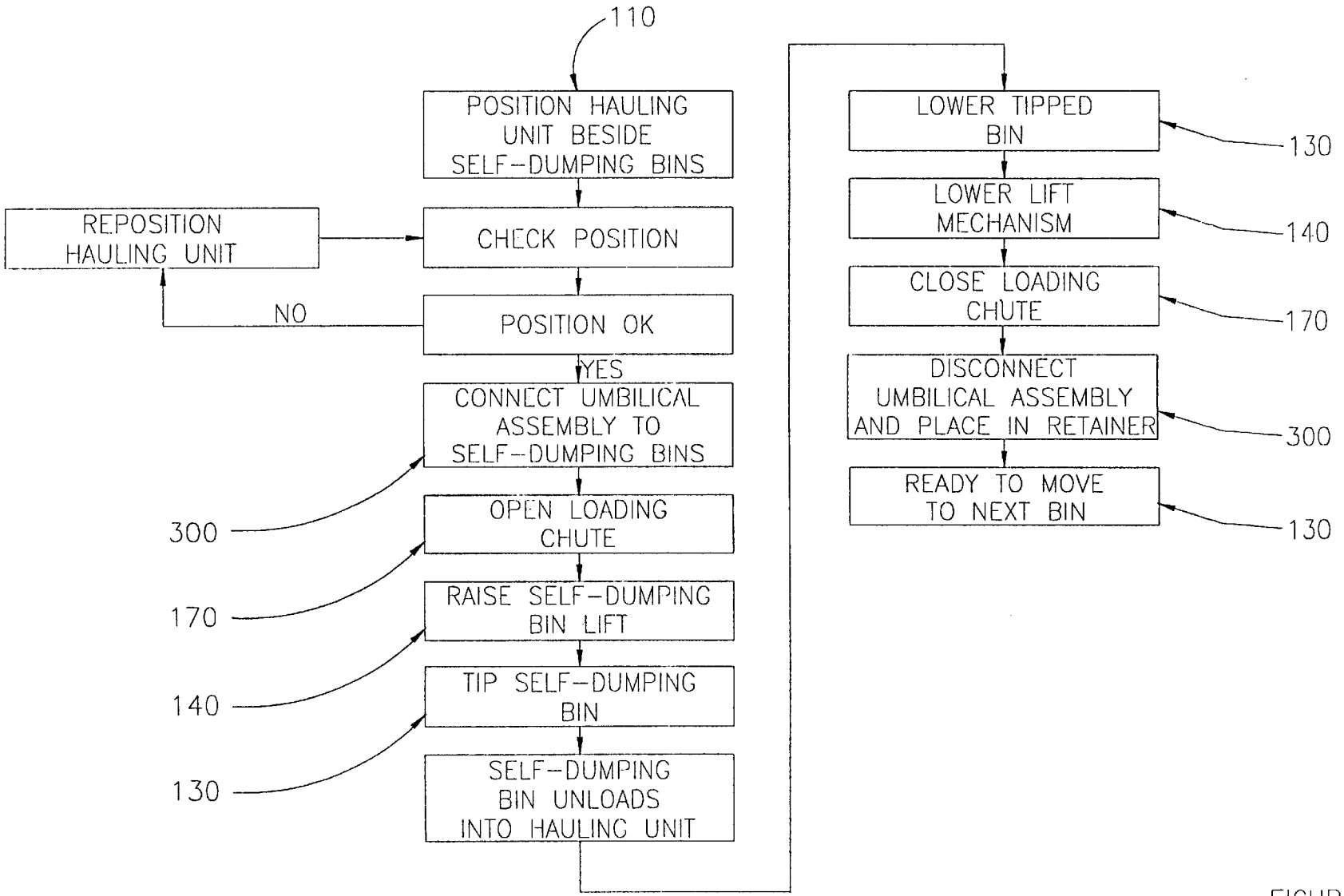
FIG. 2 is a schematic flow diagram of the process used in the operation of the invention.

FIG. 2 is a flow chart showing the sequence of events to unload the self-dumping bin 130 into the hauling unit 110.

Figure 3:
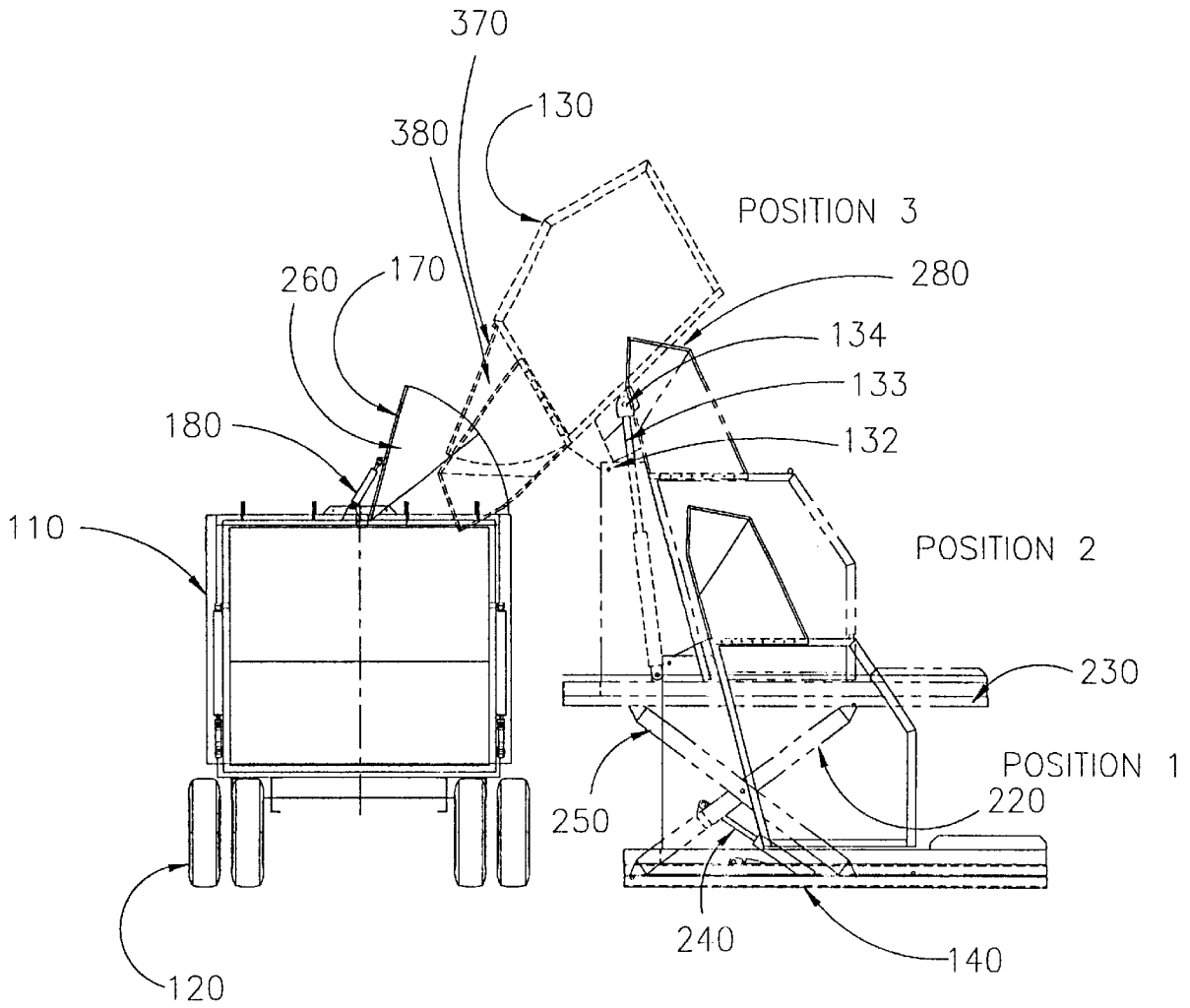
FIG. 3 is an end view of the hauling unit and a side view of the self-dumping bin illustrating movement of the bin through three positions to transfer recyclable material through the chute formed by the top door of the hauling unit.

Referring now to FIG. 3, it shows an end view of the hauling unit 110, mounted on a transporting vehicle 120, with the top loading doors 170 that form a chute open to receive material from bin 130. Top loading doors 170 are opened by hydraulic cylinders 180. Bin 130 is in the unloading position (shown with dotted lines), which is tilted at the proper angle to unload by tip cylinder 133 and is lifted by a lifting mechanism 140. FIG. 3 also shows the bin in the down and not tipped, position 1, lift mechanism raised and bin not tipped, position 2, and bin raised and tipped, position 3.

Figure 4:
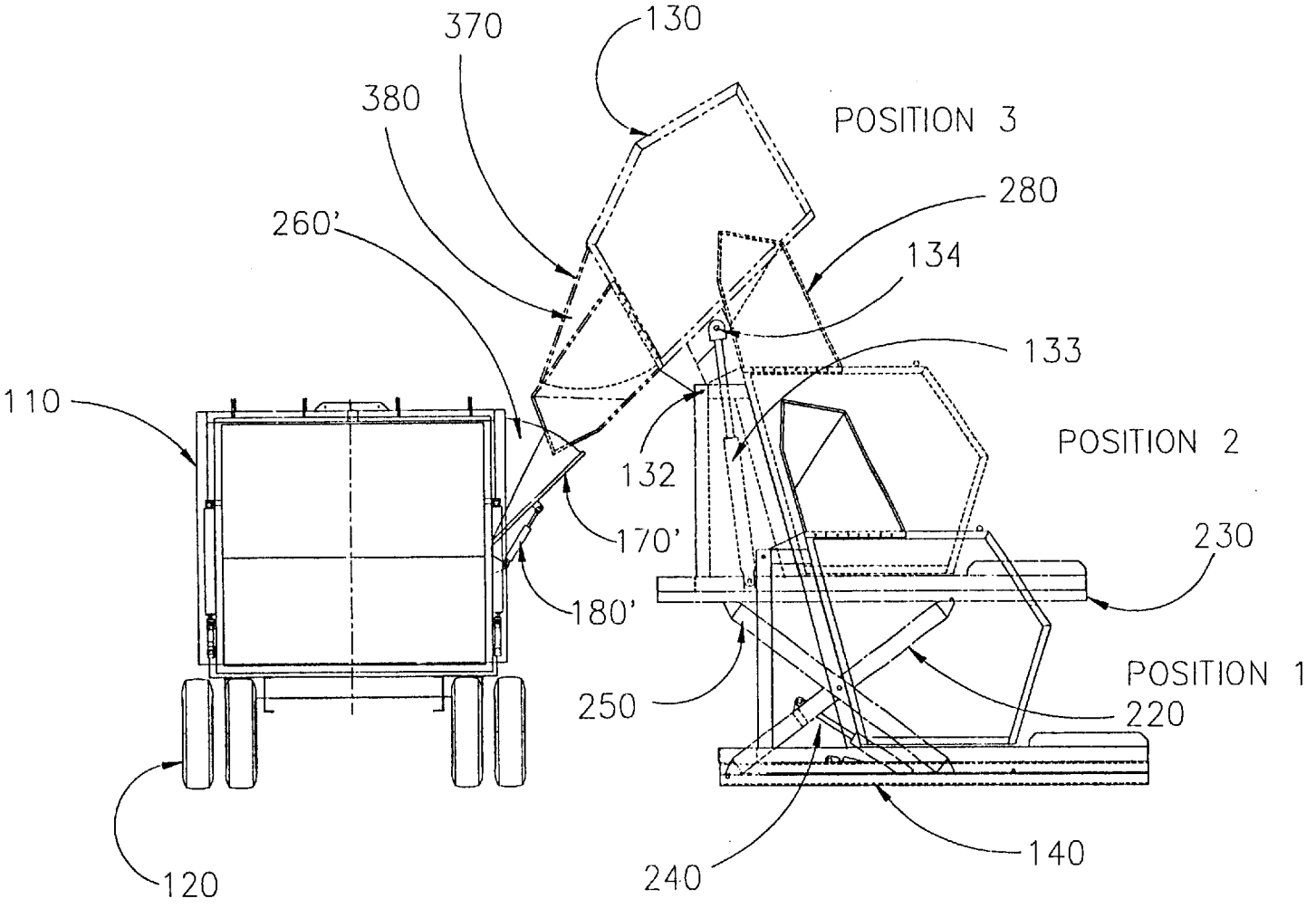
FIG. 4 is an end view in accordance with FIG. 3 except the side door of the hauling unit forms the chute.

FIG. 4 is similar to FIG. 3, except for showing that a side loading door 170' forming a chute can be used, instead of the top loading door 170, shown in FIG. 3. Side loading door 170' is opened by hydraulic cylinder 180'.

Figure 5:
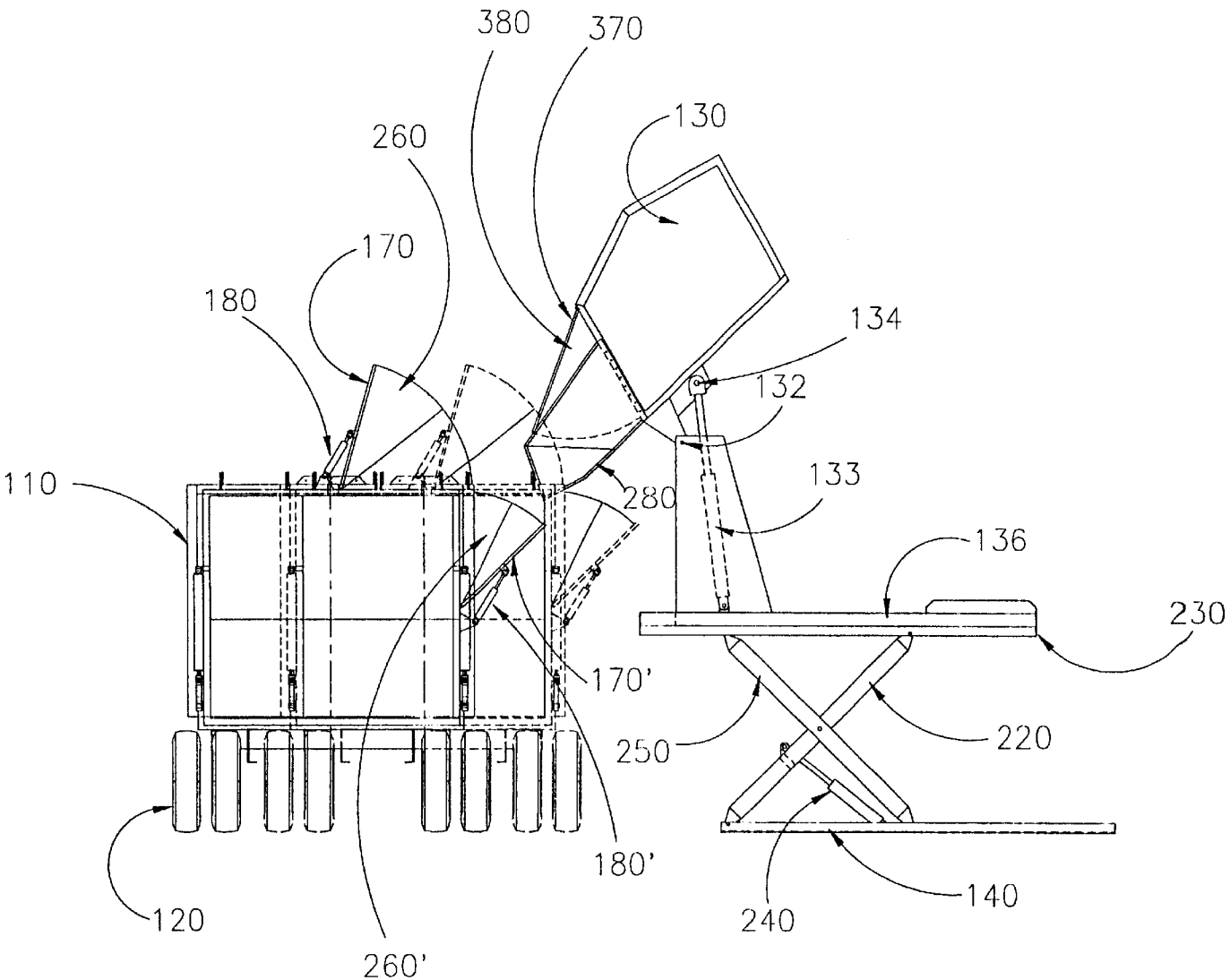
FIG. 5 is another end view showing the chute being formed by the top and side doors of the hauling unit and further showing the effective range of possible lateral locations of a hauling unit.

FIG. 5 is similar to FIGS. 3 and 4, except for showing that a top loading door 170 forming a chute can be used and a side loading door 170' can be used to increase the load opening size, if needed. FIG. 5 also shows that the hauling unit 110 has a minimum and maximum distance that can be offset from lift mechanism 140 and self-dumping bin 130 and still be in a correct position for the self-dumping bin 130 to unload.

CONSTRUCTION OF THE LIFTING MECHANISM FOR SELF-DUMPING BINS

Two common types of lifting devices that could be used to lift the self-dumping bin are a scissors lift and a parallelogram lift. The disadvantages of each become apparent when you consider lifting the bin into the correct position for unloading.

First, considering the parallelogram-lifting device, the parallelogram lift, as it raises, moves the bin closer to the hauling unit. This is a desired result of lifting to prevent having to park the hauling unit too close to the bin. But the disadvantage of a parallelogram lift for use in this invention is that in order for the lift to raise to the needed height, the forward leg would extend back towards the center of the lift platform, resulting in the bin resting on the part of the lift top platform that would be unsupported by the lifting legs. Another disadvantage is that the forward motion, as the lift raises, would be too great, resulting in having to park the hauling unit at too great a distance from the bin.

Next, considering a scissors type lifting device, a scissors lift would not have the disadvantage that a parallelogram lift has, with the bin resting on the part of the lift platform that is unsupported by the lifting legs. A scissors lift would also lift the bin up in a straight line. The disadvantage of this construction would be that the hauling unit would have to be placed very close to the bin in order for the bin to be in the correct position to unload.

Figure 6:
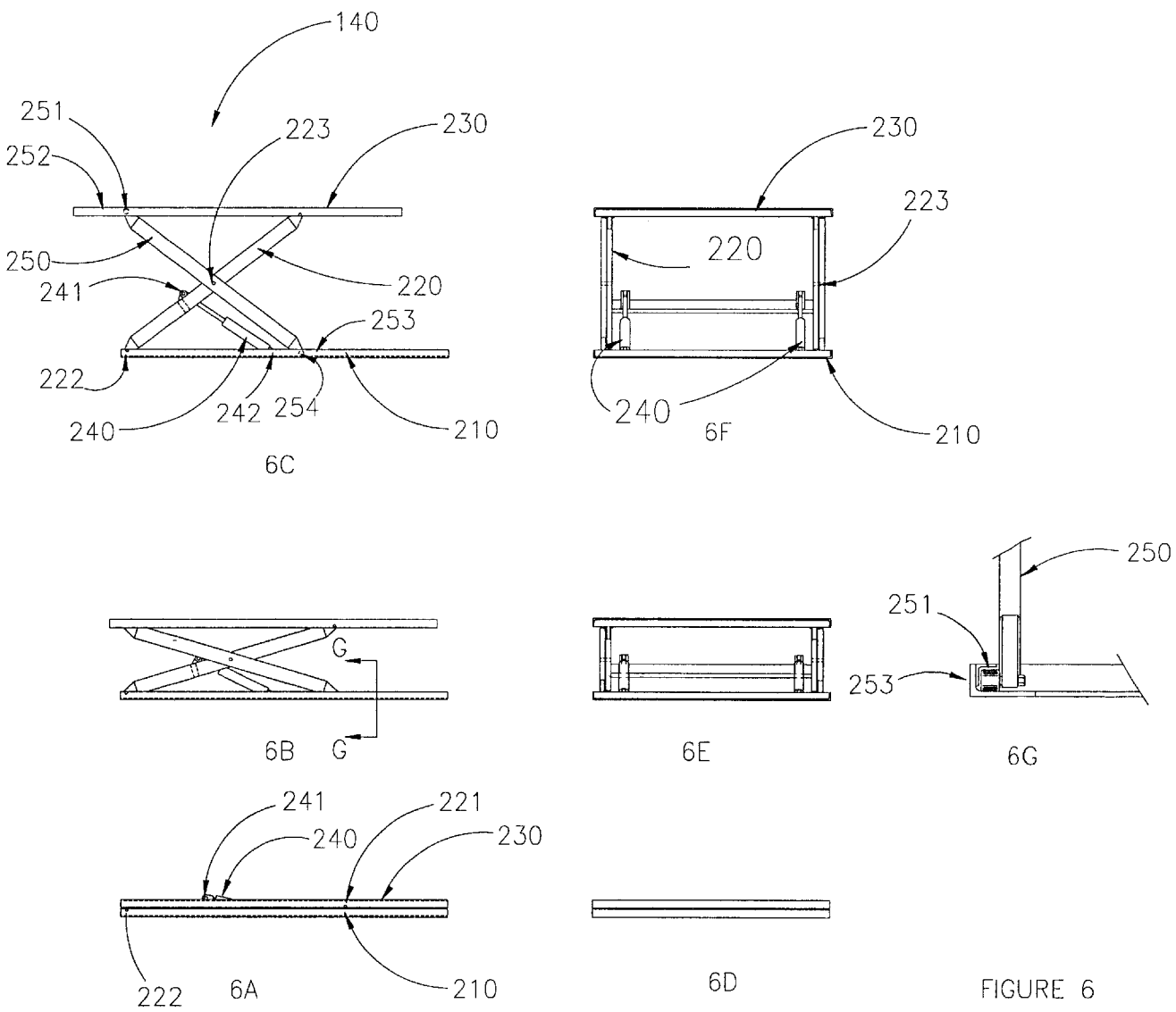
FIGS. 6A–F show a series of views of the preferred bin lifting device portion of the self-dumping bin showing the platform in several different positions from closed to fully extended taken from both the left side and the rear.
FIG. 6G shows a detail of the roller mounting of the platform.

A lifting mechanism that has the advantage of a parallelogram lift and a scissors lift, but without the disadvantage of either, would be the preferred type of lifting mechanism. A lifting mechanism of this type would lift the bin to the correct height, while keeping the lifting legs properly positioned under the bin for support, and at the same time, move the bin towards the hauling unit. A lift of this type is shown in FIG. 6.

Referring now to FIGS. 6A, 6B, 6C, 6D, 6E, 6F, and 6G, there are shown six views of the lifting mechanism 140 and an additional view of a detail of the roller assembly which allows the platform to move laterally as well as vertically. Those views include two views in the lowered position, namely, FIGS. 6A and 6D, two views in the partially raised position, namely, FIGS. 6B and 6E, and two views in the raised position, namely, FIGS. 6C and 6F. Referring to FIG. 6C, showing a side view in the raised position, the lifting mechanism includes a lower frame assembly 210, lift arms 220, pivotally mounted to lower frame assembly 210 by pivot pin 222 and to top frame assembly 230 by pivot pin 221. The lift arms 220 are raised and lowered by hydraulic cylinders 240. The hydraulic cylinders 240 are pivotally attached to the lower frame 21 by pin 242 and to lift arm 220, by pin 241. As the hydraulic cylinders 240 extend, lift arm 220 moves the top frame assembly 230 vertically and horizontally to position bin 130 for unloading. Idler arm 250 maintains the top frame assembly in the level position. Idler arm 250 is pivotally attached to the lift arm 220 by pin 223. Pivot pin 223 is located at the center of lift arm 220 and idler arm 250. The lower end of idler arm 250 has a roller 254 attached. Roller 254 rolls in and is supported by roller track 253, which is attached to lower frame assembly 210. The upper end of idler arm 250 has a roller 251 attached. Roller 251 rolls in and is supported by roller track 252, which is attached to upper frame assembly 230.

Figure 7:
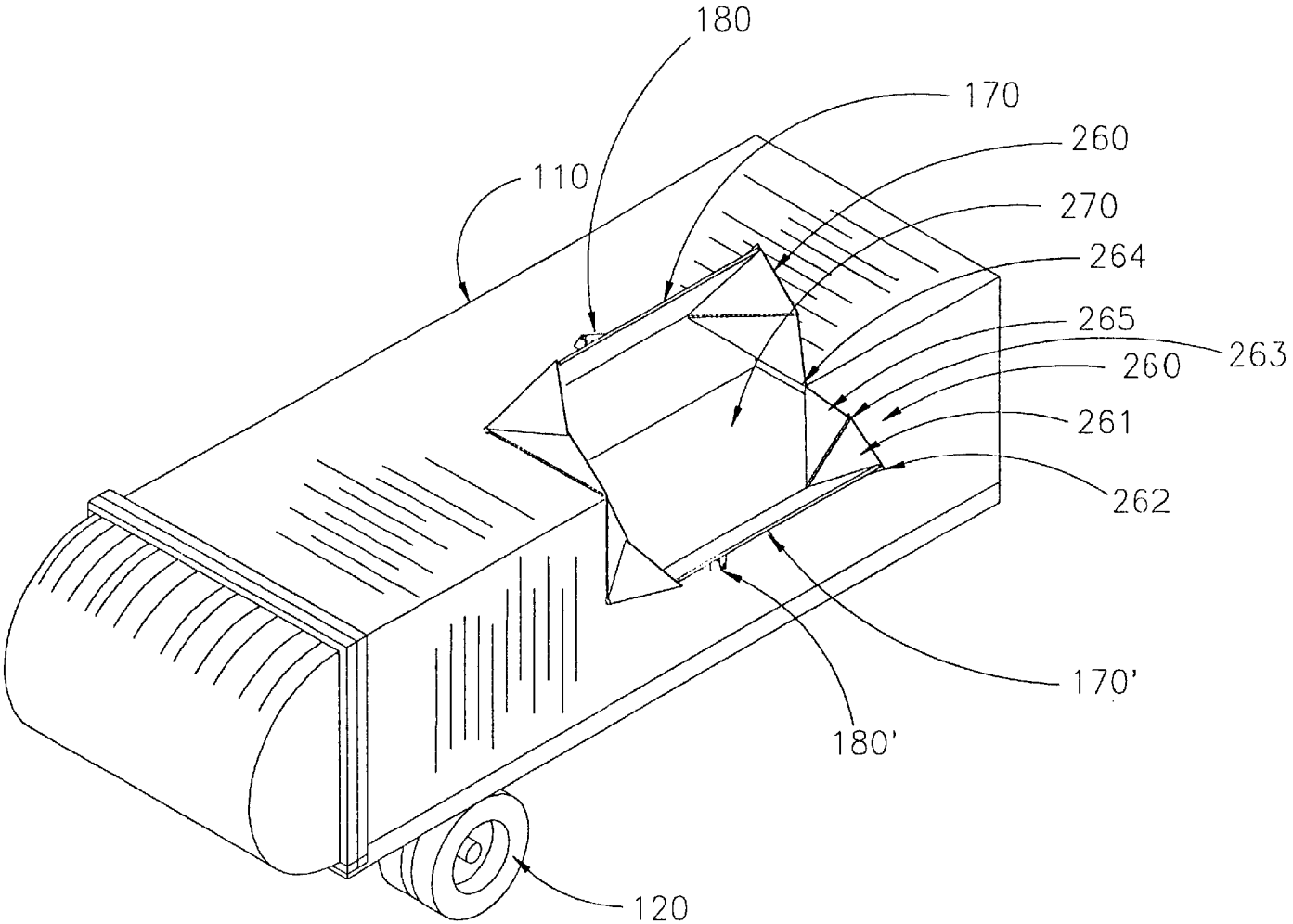
FIG. 7 is a partial perspective view of the chutes formed by the top and side doors.

Referring to FIG. 7, this Figure shows the hauling unit 110, which can be either a trailer or a truck chassis mounted with a top door 170 and a side door 170' to form an open loading chute, ready to receive refuse or recyclables from the self-dumping bins 130. A baffle means 260 is attached to each side of the load doors 170 and 170', so that the doors and the baffle form a receiving chute to reduce spillage when unloading the self-dumping bins 130 into the hopper 270. Baffle means 260 is composed of an outer part 261, which is hinged by hinge 262 at the ends of loading door 170 and by center hinge 263 secured to the inner part 265. The inner part is hinged by hinge 264 to the hauling unit. When the loading doors 170 and 170' are opened, the baffle 260 will not fold out to 180° but is always biased to fold outward from the load opening when the loading doors 170, 170' are closed.

Figure 8:
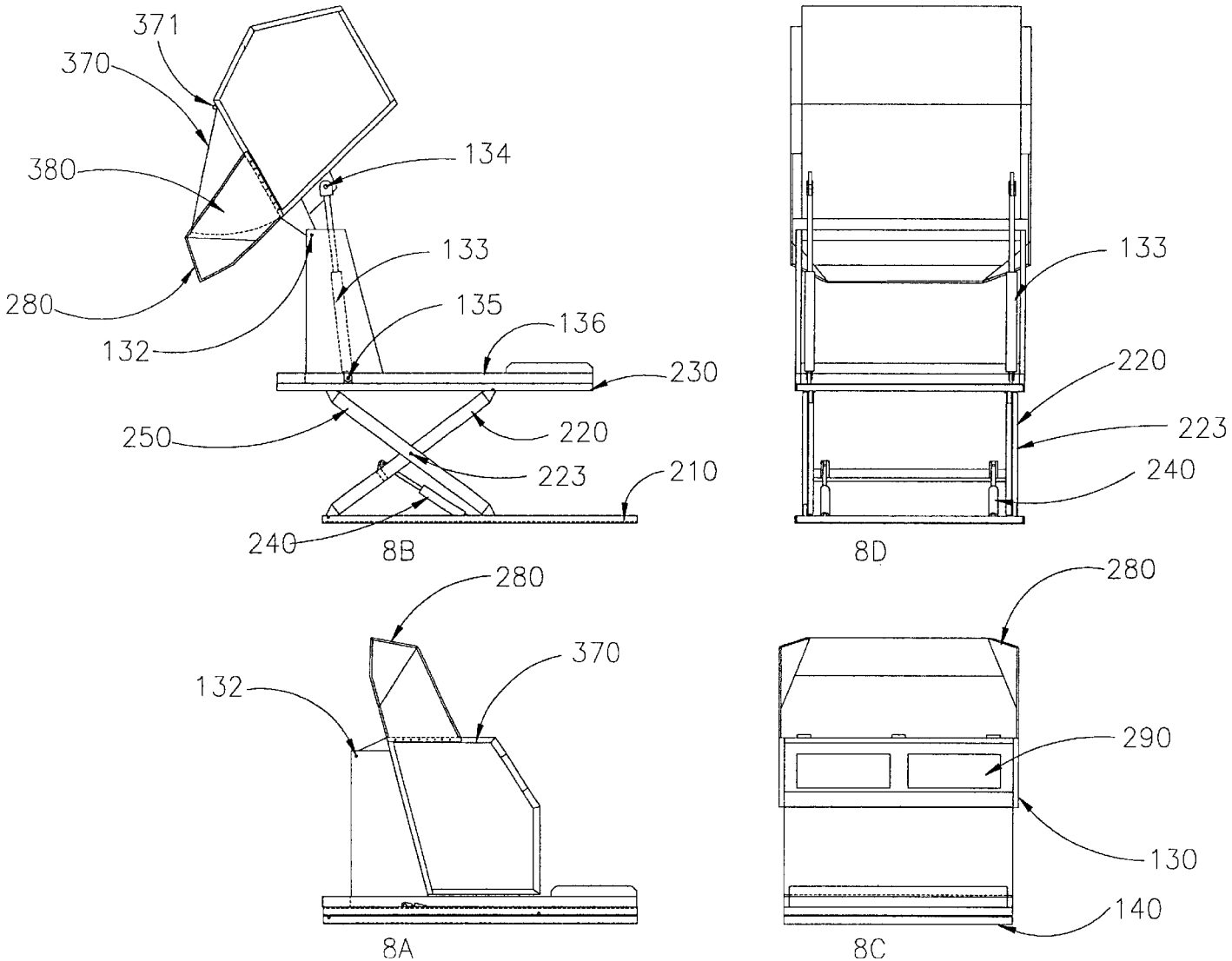
FIGS. 8A–B show side views of the self-dumping bin, 8A in the collection position and 8B in the dumping position, while 8C–D show the bin in respective front views.

FIG. 8 is a side view, FIGS. 8A and 8B, and a front view, FIGS. 8C and 8D, of the self-dumping bin 130 in the raised and lowered position, supported on lifting mechanism 140. The bin 130 is equipped with a tapered lip 280, which forms a funnel for evacuating items stored in the bin 130 into the hopper 270 of the hauling unit 110. The self-dumping bin 130 is also equipped with at least one door or opening 290 to load refuse or recyclables. Bin 130 is supported by and pivotally attached to self-dumping bin base frame 136 by pivot pin 134. The bin 130 is tipped into the dumping position shown in View A by bin tip hydraulic cylinder 133.

Hydraulic cylinder 133 is pinned to the bin base frame by lower cylinder pin 135 and to self-dumping bin 130 by upper cylinder pin 134. Bin 130 is equipped with an unloading door 370. Door 370 is pivotally attached to bin 130 by hinge 371. Unloading door 370 has a flexible side material 380 that forms side to the unloading door 370 to reduce spillage when the self-dumping bin 130 is unloading material into the hopper 270 of hauling unit 110.

Figure 9:
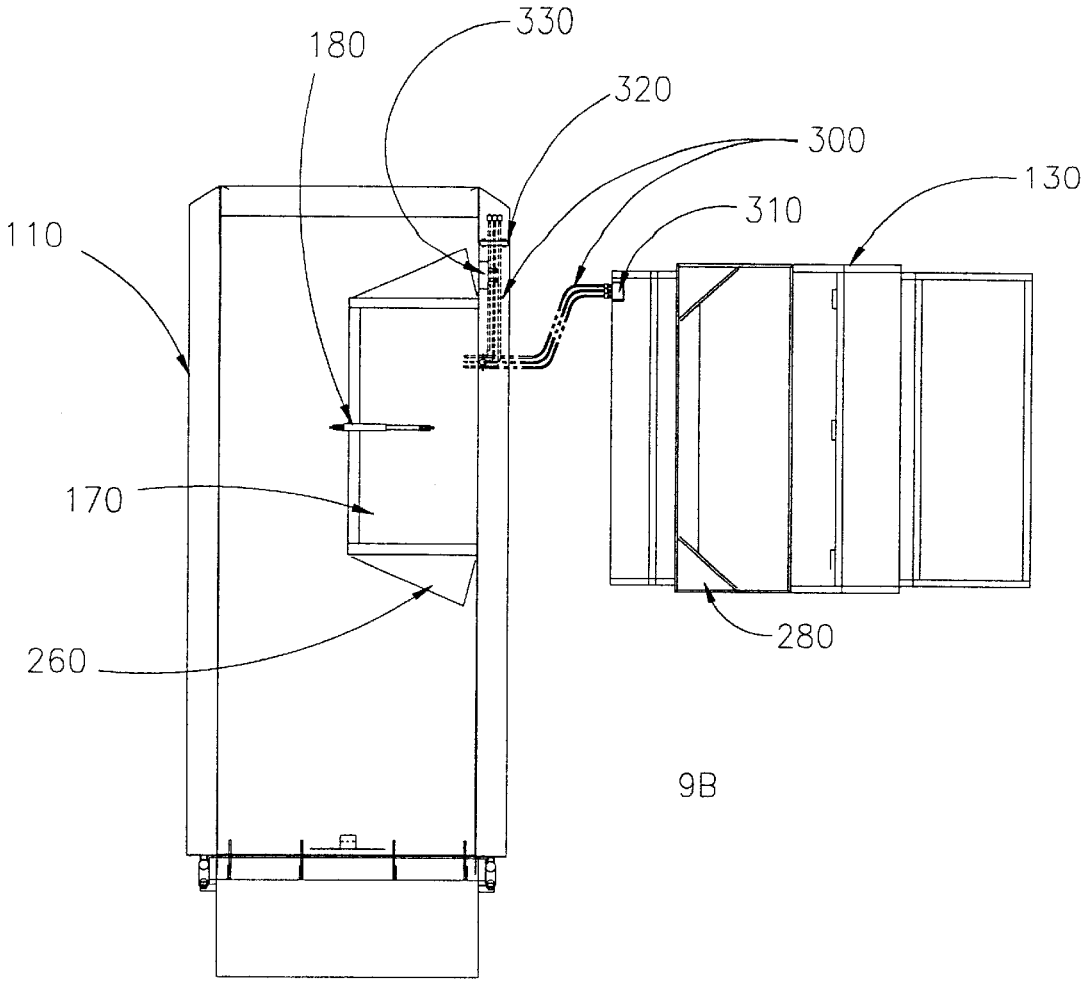
FIGS. 9A–B show side and top views respectively of the hydraulic connection of the hauling unit to the self-dumping bin.
Figure 9:
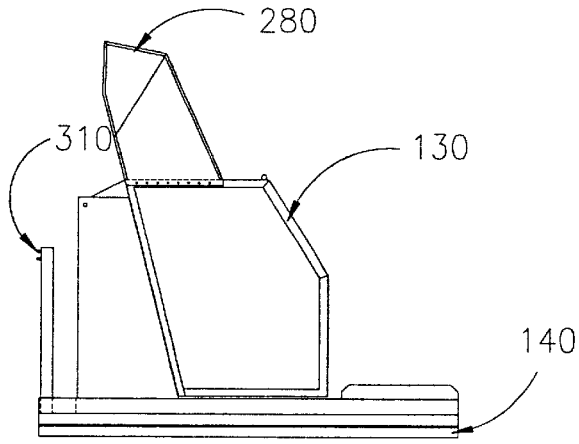

FIG. 9 in view 9B shows the hauling unit 110 positioned adjacent to the self-dumping bin 130 with the umbilical assembly 300 shown connected to the power connection 310 which is attached to the lower frame of the lifting mechanism 140. The umbilical assembly 300 supplies power to operate the lift mechanism 140 and the tipping mechanism of the self-dumping bin 130. Controllers 330 are mounted on the hauling unit 110 to operate the lift mechanism 140 and the self-dumping bin 130. Retainer 320 is used to retain umbilical assembly 300 to the hauling unit 110 when the hauling unit is being moved. View 9A is a side view of the self-dumping bin 130 mounted on lift mechanism 140 to further illustrate the preferred location of the power connection 310.

Figure 10A:
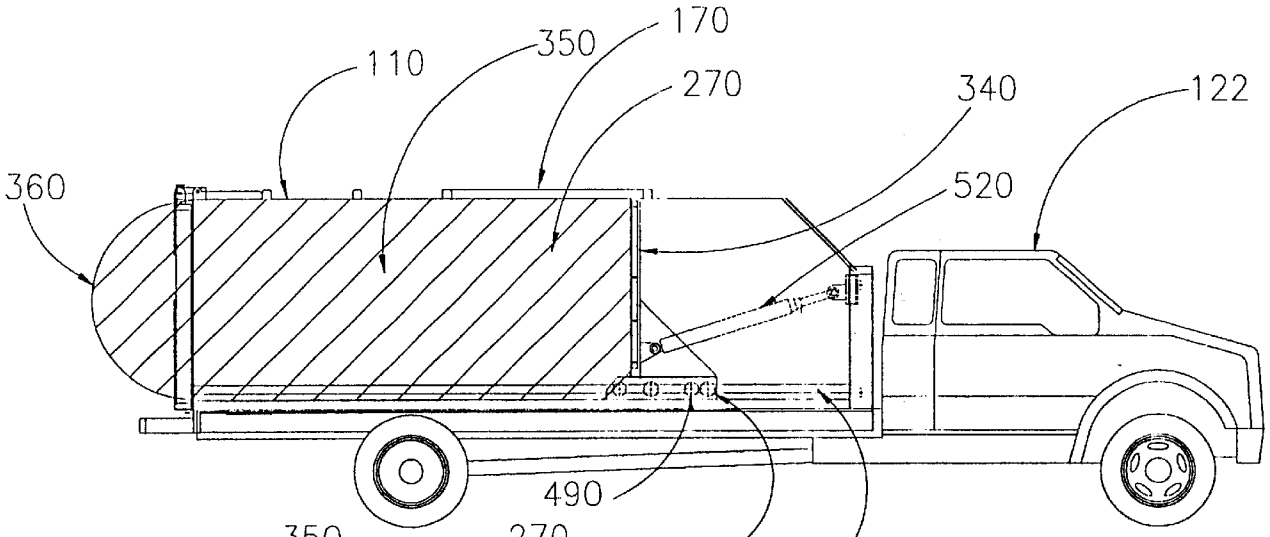
FIGS. 10A–B show side views respectively of the ram removing the material from the hopper and compacting it into the compaction chamber of the hauling unit.
Figure 10B:
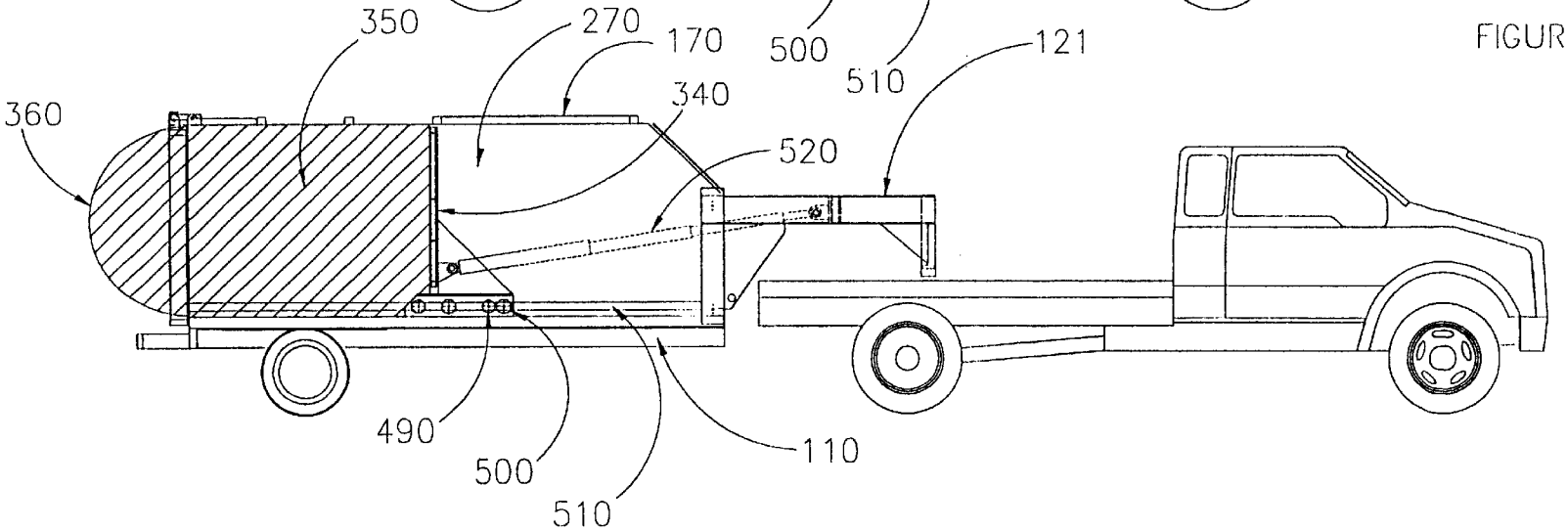

FIG. 10A shows the hauling unit 110 mounted on a truck chassis 122, with the compaction chamber 350 and the hopper 270 filled with uncompacted material, and the compaction/ejection ram 340 in the forward position. FIG. 10B shows the hauling unit 110 mounted on a trailer 121. In this view, the loose material in the hopper 270 and the compaction chamber 350 has been compacted by compaction/ejection ram 340 against the tailgate 360.

Figures 11A, 11B:
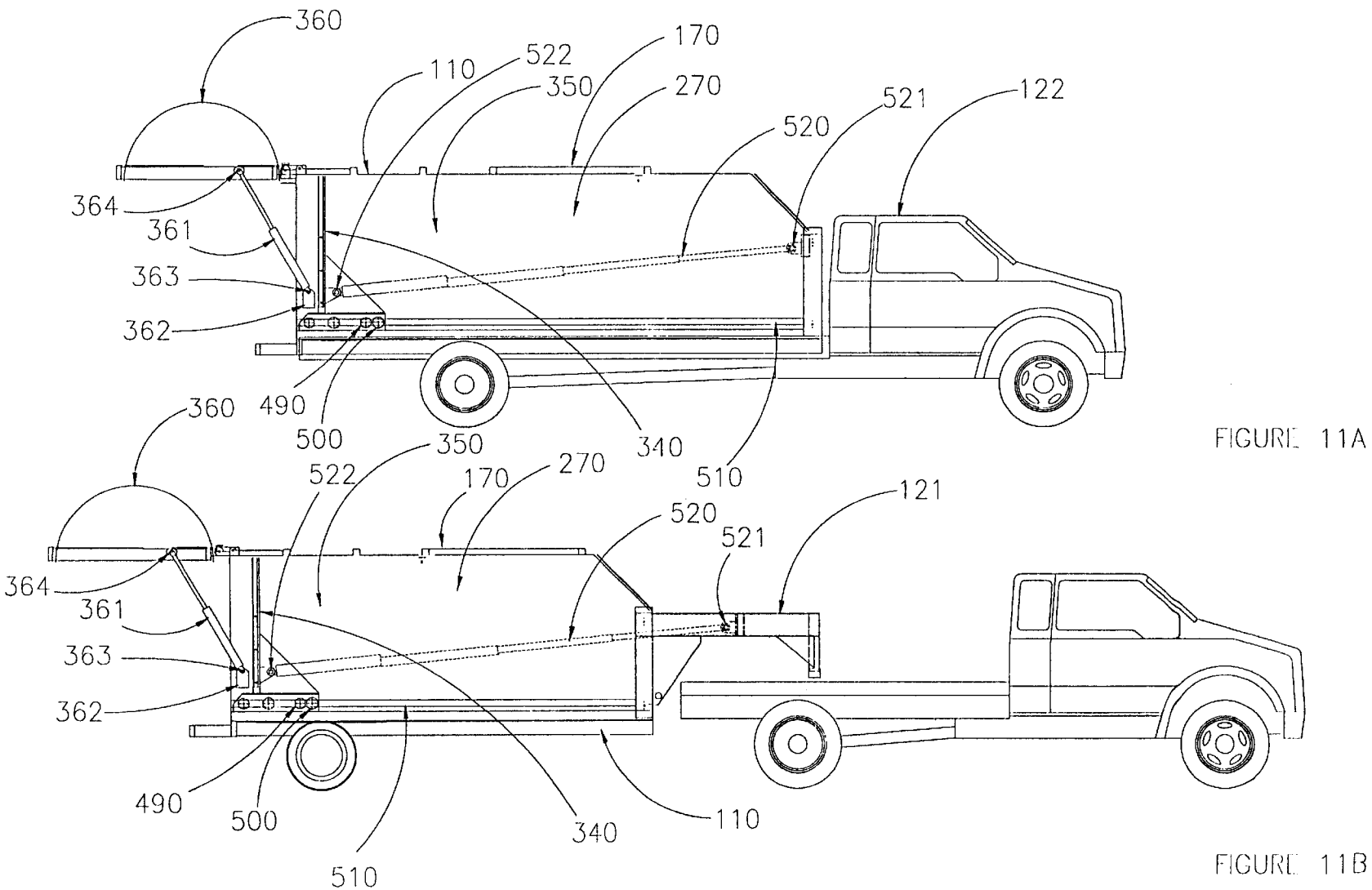
FIGS. 11A–B are side views of the tailgate open allowing the ram to eject the material from the hauling unit, respectively truck mounted or trailer mounted.

FIG. 11A shows the hauling unit 110 mounted on a truck chassis 122 while FIG. 11B shows the hauling unit 110 mounted on a trailer 121, with the tailgate 360 open and the compaction/ejection ram 340 in the extended or unloading position. In this position, the ram 340 will have ejected all the collected and compacted material out of the rear end of the hauling unit 110. Referring again to FIGS. 10A, 10B, 11A, and 11B, these figures show the preferred method of guiding the compaction/ejection ram 340 through the hopper 270 and compaction chamber 350. The hauling unit 110 is equipped with a left and a right side steel guide track 510. The compaction/ejection ram 340 is equipped with left and right horizontal steel bearing rollers 500 to support the compaction/ejection ram 340 as hydraulic cylinder 520 advances the ram 340 to compact or eject material. The ram 340 is also equipped with left and right vertical steel rollers 490. These rollers keep the ram centered as it advances through the hopper 270 and compaction chamber 250. Tailgate 360 is opened by hydraulic cylinder 361. Hydraulic cylinder 361 is pivotally attached to the tailgate 360 by pin 364 and to latch bar 362 by pin 363. Tailgate 360 is pivotally attached to hauling unit 110 by pin 365.

Figure 12:
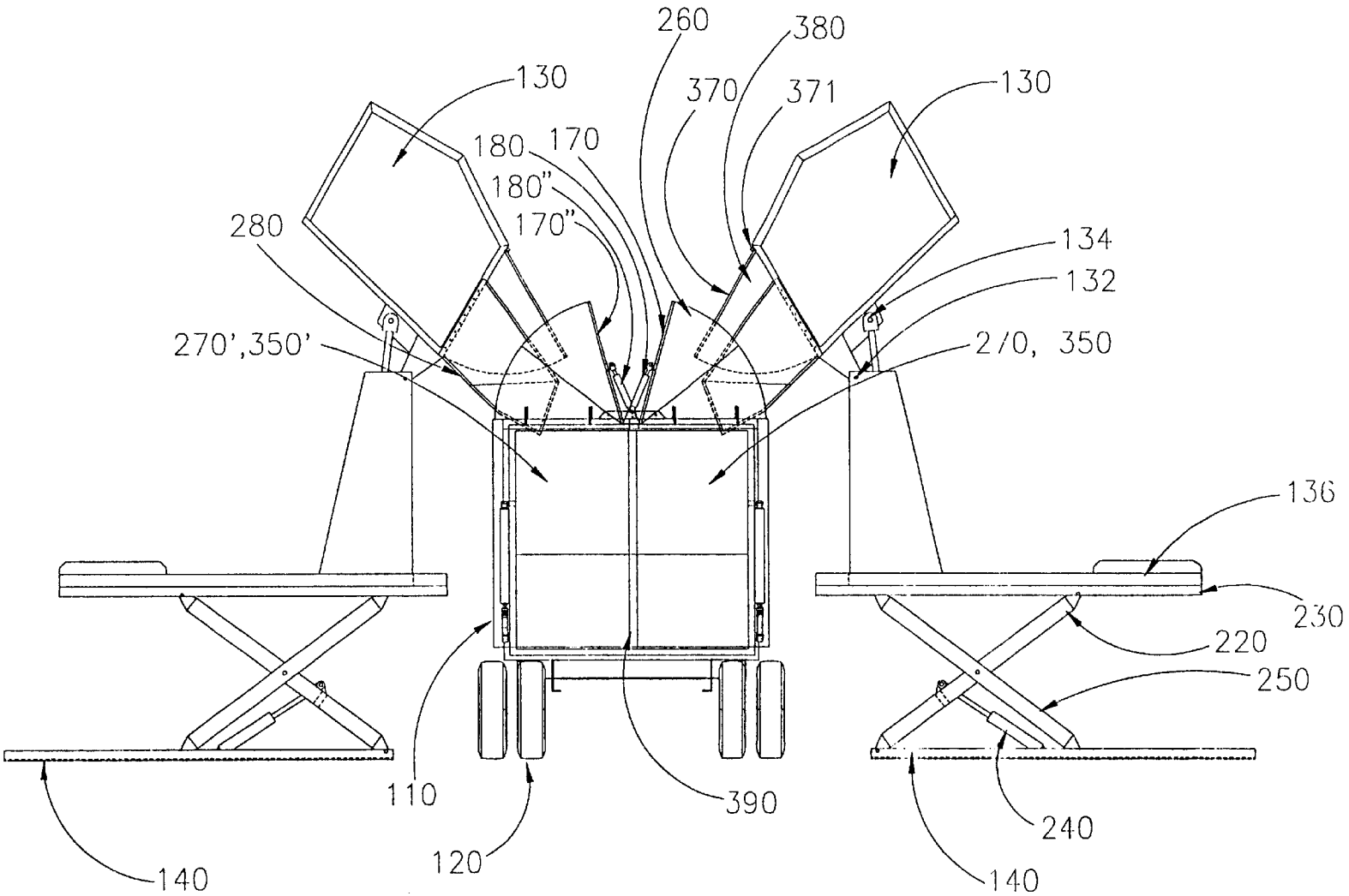
FIG. 12 is an end view of the hauling unit receiving materials from bins dumping from each side of the hauling unit into a top chute.

FIG. 12 shows a pair of the self-dumping bins 130 lifted on lifting mechanisms 140, and tipped in the unloading position on the left side, and on the right side, of the hauling unit 110. FIG. 12 demonstrates that the hauling unit 110 can be equipped with left loading door 170" or right loading door 170, or the hauling unit 110 can be divided in the center by partitions 390 and equipped with a right side loading door 170 and a left side loading door 170". In this mode, the hauling unit 110 will also have a right side hopper 270, and a left side hopper 270', and a right side compaction chamber 350, and a left side compaction chamber 350'. FIG. 12 also shows that when self-dumping bin 130 is in the tipped position, the bin top door 370, which is pivotally attached to the bin by hinge 371, opens. The top door 370, in conjunction with the door baffle 380 and the tapered lip 280, form a chute that mates with the top door 170 serving as the loading chute of the hauling unit 110, which chute reduces the spillage of material when unloading the bin 130 into the hopper 270.

Figure 13:
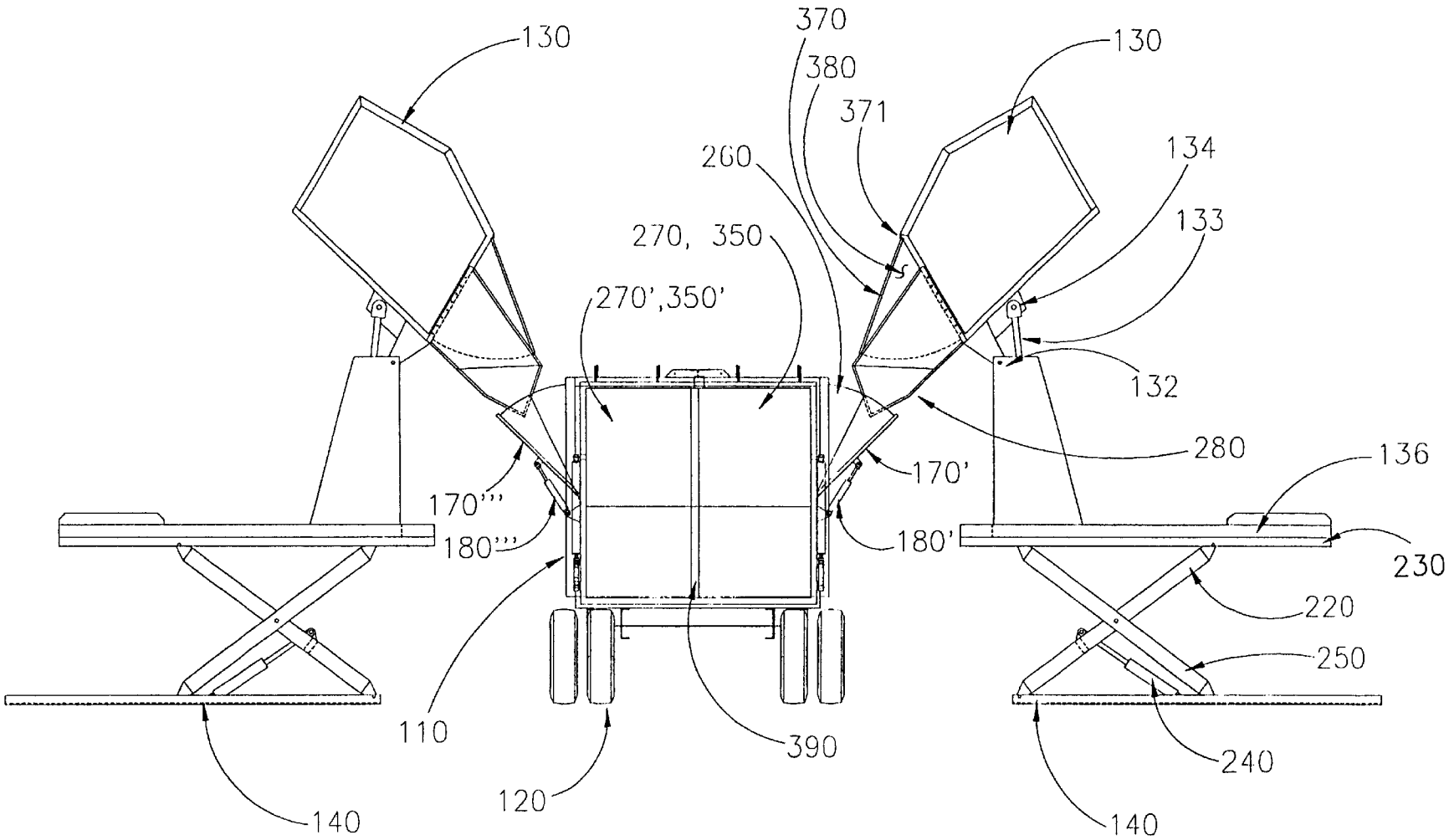
FIG. 13 is an end view of a dual chamber hauling unit receiving two different types of material, one from either side of the hauling unit.
Figure 14:
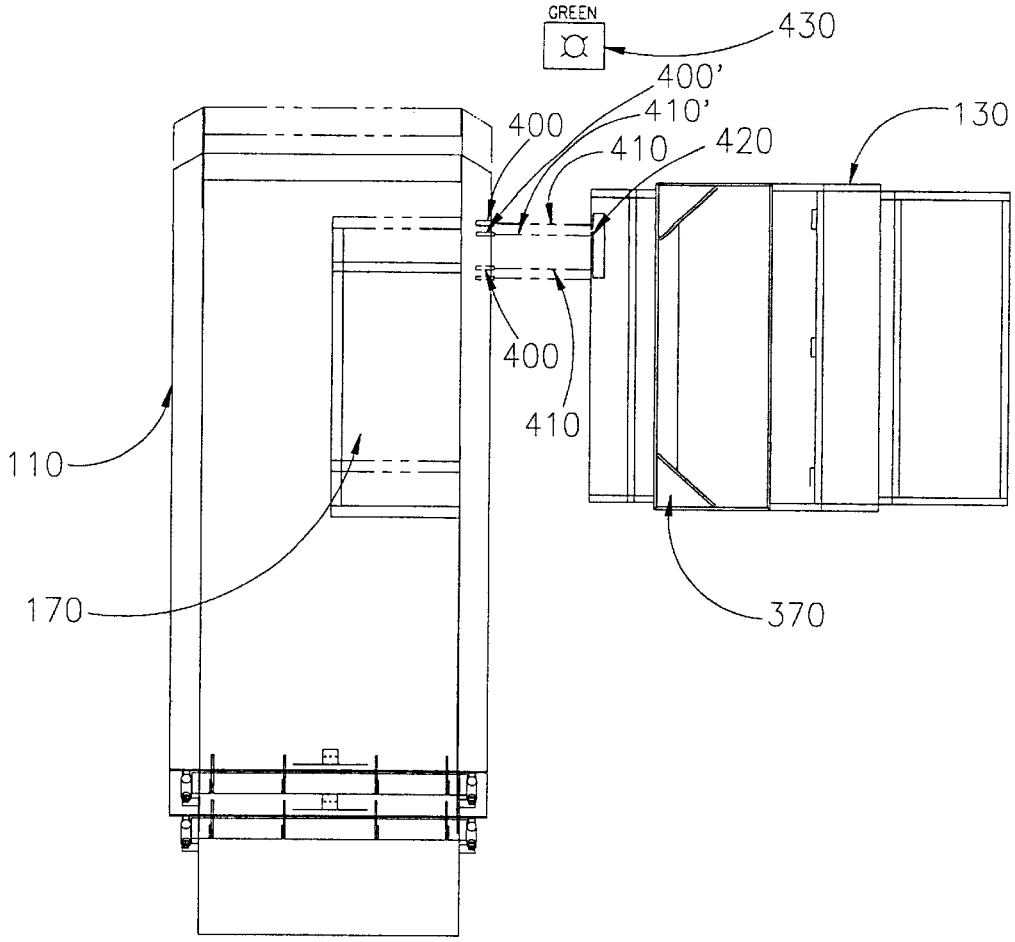
FIGS. 14A–B show the use of photoelectric sensor devices to indicate to the driver proper positioning of the hauling unit for collection.
Figure 14:
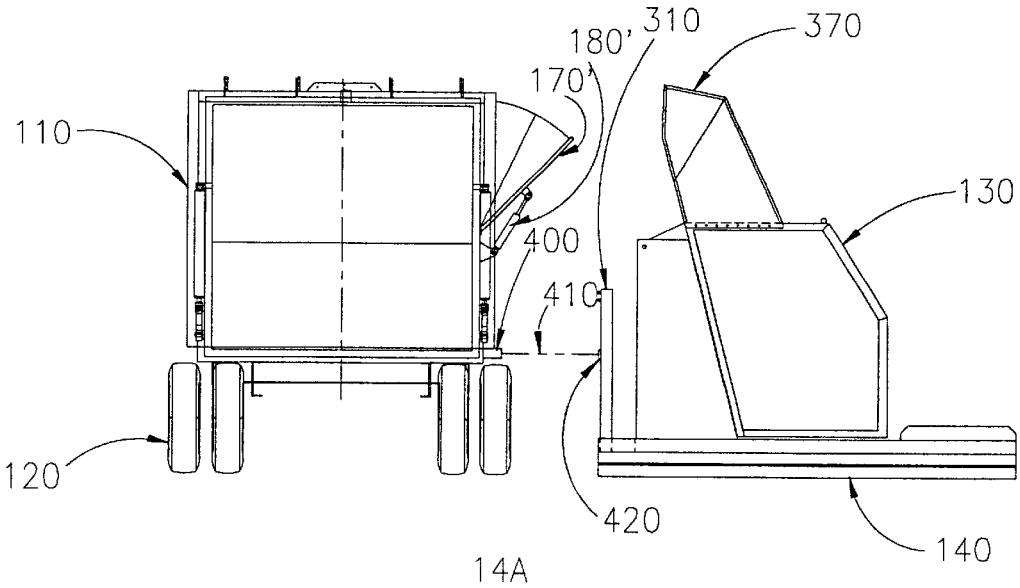

FIG. 13 is similar to FIG. 12, except that it shows that side collection doors 170' and 170'" can be used in place of top collection doors 170 and 170".

FIGS. 14A and 14B show the use of an indicating means to the hauling unit 110's operator that the hauling unit 110 is in the correct position to unload the self-dumping bins 130 into the hauling unit 110. In this method a photoelectric sensor 400 is mounted on the hauling unit 110. The photoelectric sensor 400 transmits an infrared light beam 410 to a reflective surface 420 mounted on the power connection 310 stand. The infrared light beam 410 is then reflected back to the receiver unit, which is part of the photoelectric sensor 400. When the photoelectric sensor 400 is receiving reflected light back, a green light 430 will come on. This green light 430 would preferably be mounted in the cab of the hauling vehicle 120. The reflective surface 420 is made just long enough so the green light 430 will come on when the hauling unit 110 advances to the rear-most position to unload the bin 130. In this position the hauling unit 110 is shown with solid lines. The end of the hauling unit 110 is also shown with broken lines. This indicates that if the hauling unit 110 advances past this point the green light 430 will go out and the hauling unit 110 is not in position for the bin to be unloaded. The photoelectric sensor 400 can also be adjusted so that the green light 430 will only come on if the hauling unit 110 is not at too great a distance laterally from the self-dumping bin 130. A second photoelectric sensor 400' could be added to indicate that the hauling unit 110 is too close to the self-dumping bin 130. The preferred method would be to use two photoelectric sensors 400 and 400'. When this method is used, the hauling unit 110 must be in the correct position and also, in the correct range, laterally, before the green light 430 will come on. The sensor 400' also transmits an infrared beam 410'. Sensor 400' will be set at the correct distance, laterally, so that if the hauling unit 110 is too close to self-dumping bin 130, it will prevent the green light 430 from coming on.

Figure 15:
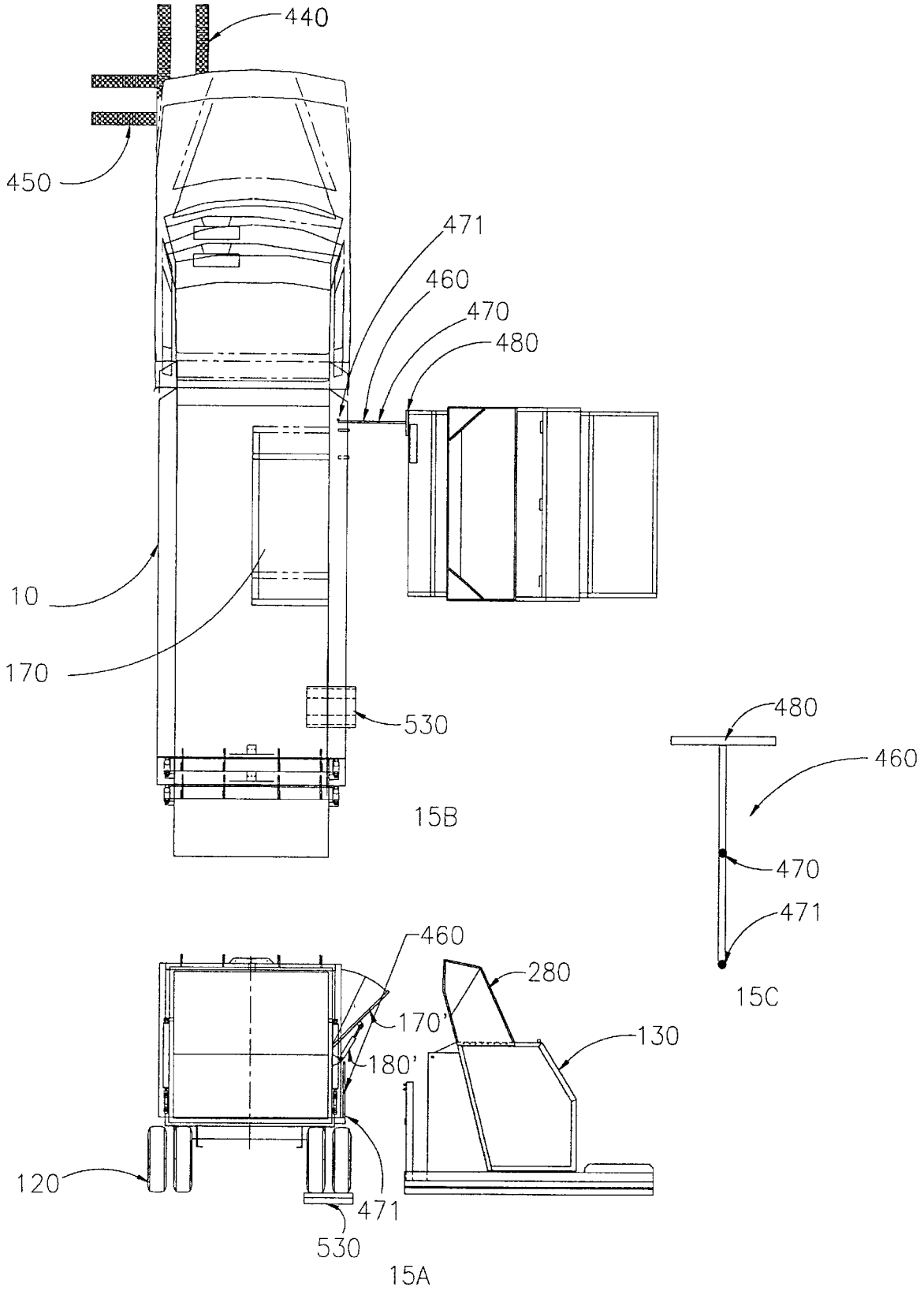
FIGS. 15A–C show a mechanical indicating means for indicating proper positioning of the hauling unit for collection.

There are different ways of indicating that the hauling unit 110 is in the correct range to unload bin 130. FIG. 15 shows three possibilities:

(1) FIG. 15B shows that two parallel lines 440 can be painted parallel to and at the correct distance laterally from the bin 130, so that if the left edge of the hauling unit 110 is between these lines, the hauling unit 110 is at the correct distance laterally from the bins 130 to unload. Two lines perpendicular 450 to the parallel lines 440 can be used to indicate that the transporting vehicle 120 is stopped at the correct position for unloading bin 130.

(2) FIG. 15A shows that another method to indicate that the hauling unit 110 is in the correct range to unload bin 130 would be to use a hinged bar 460 with a tee handle 480, as shown in FIG. 15C. The hinged bar 460 would pivot down from the hauling unit 110 at pivot point 471 and would have a second pivot 470 to indicate the minimum distance from the bin 130 the hauling unit 110 can be positioned. The full length of the hinged bar 460 would indicate the maximum distance the hauling unit 110 can be from the bin 130. The tee handle 480 would be made the correct length so that when the hinged bar 460 is down, and the edge of bin 130 is within the length of the tee handle 480, the hauling unit 110 is in the correct forward position.

(3) The last method, as shown in FIGS. 15A and 15B, would be to attach to the ground surface an indicating device 530. This indicating device 530 would have two raised surfaces, or bumps, that the transporting vehicle 120's rear tires would roll over if the hauling unit 110 was moving parallel and at the correct lateral distance from the bin 130. The two raised surfaces on indicating device 530 would be spaced apart so that when the rear tires go over the first bump, but do not go over the second bump, the hauling unit 110 is in the correct forward position.

FIGS. 16A and 16B show the maximum "a" and minimum "b" distance, laterally, that the hauling unit 110 can be from the self-dumping bin 130 when the hauling unit's transporting vehicle is a trailer 121. In FIGS. 16A and 16B, the hauling unit 110 is equipped with a top door 170 and a side door 171' for loading. With this arrangement the maximum distance "a" is approximately 60 inches, as shown in FIG. 16A. The minimum distance "b" is shown in FIG. 16B and is approximately 37 inches. FIGS. 16C and 16D show the minimum "b" and maximum "a" distance that the hauling unit 110 can be from the self-dumping bin 130 when the hauling unit 110 is equipped with a top load door 170 only. In FIG. 16C the maximum distance "a" is approximately 47 inches and the minimum distance "b" is approximately 30 inches. FIGS. 16E and 16F show the minimum "b" and maximum "a" distance that the hauling unit 110 can be from the self-dumping bin 130 when the hauling unit 110 is equipped with a side load door 170' only. In FIG. 16E the maximum distance "a" is approximately 66 inches and the minimum distance "b" is approximately 62 inches.

Figure 16:
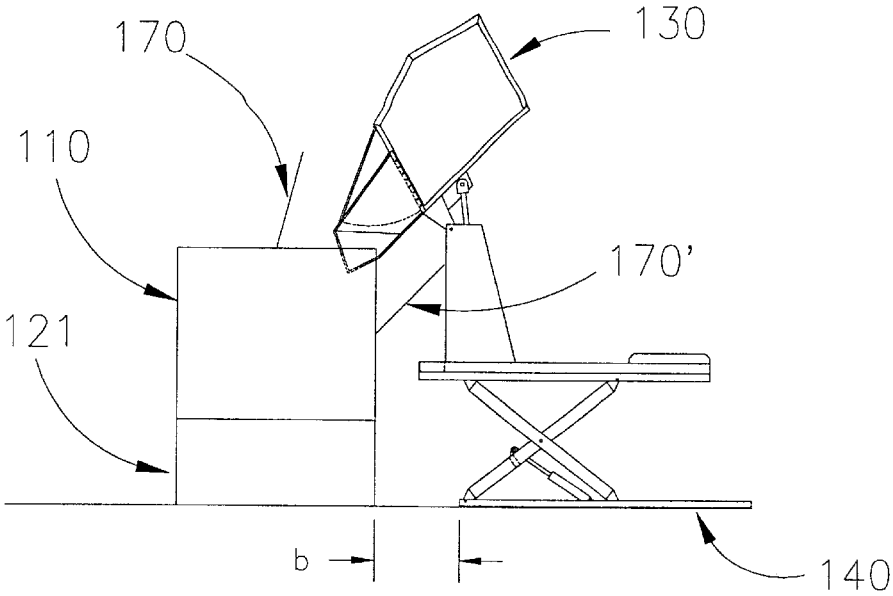
FIGS. 16A–F show the maximum and minimum distances for positioning a trailer hauling unit, A–B, when top and side chutes both are available on the hauling unit for use, C–D, when a top only chute is available, and E–F, when a side only chute is available.
Figure 16:
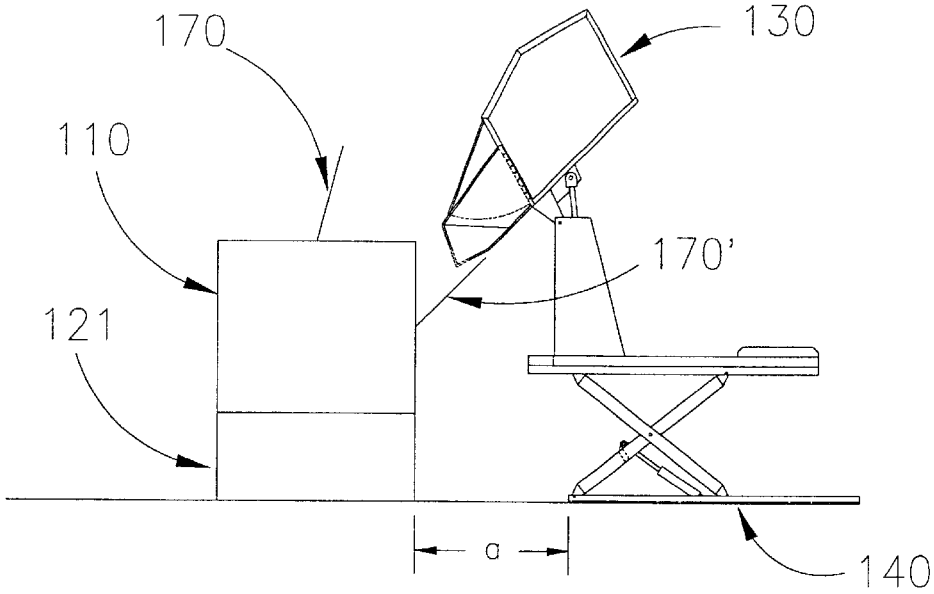
Figure 16:
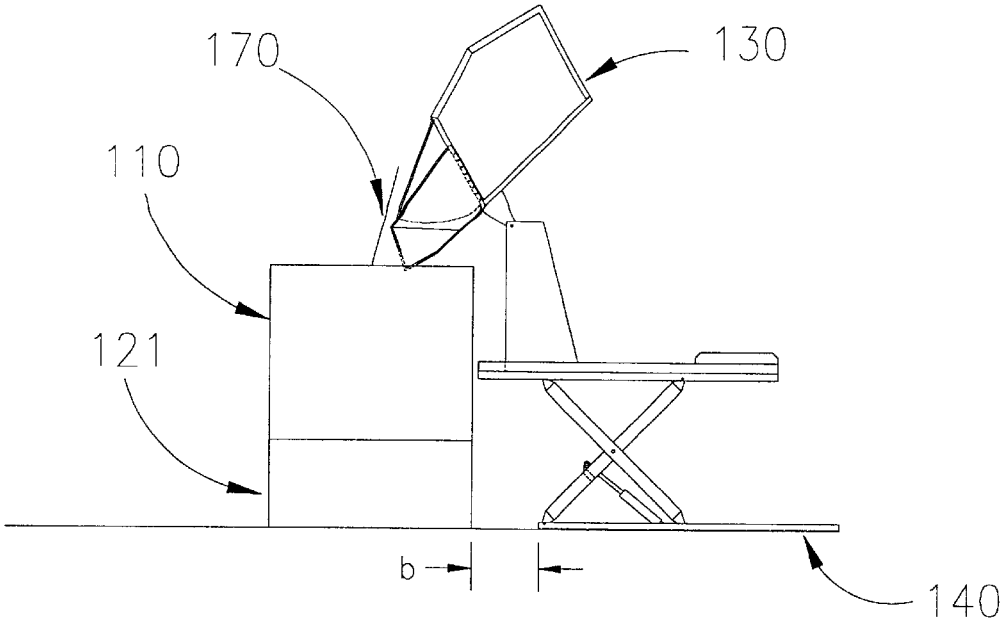
Figure 16:
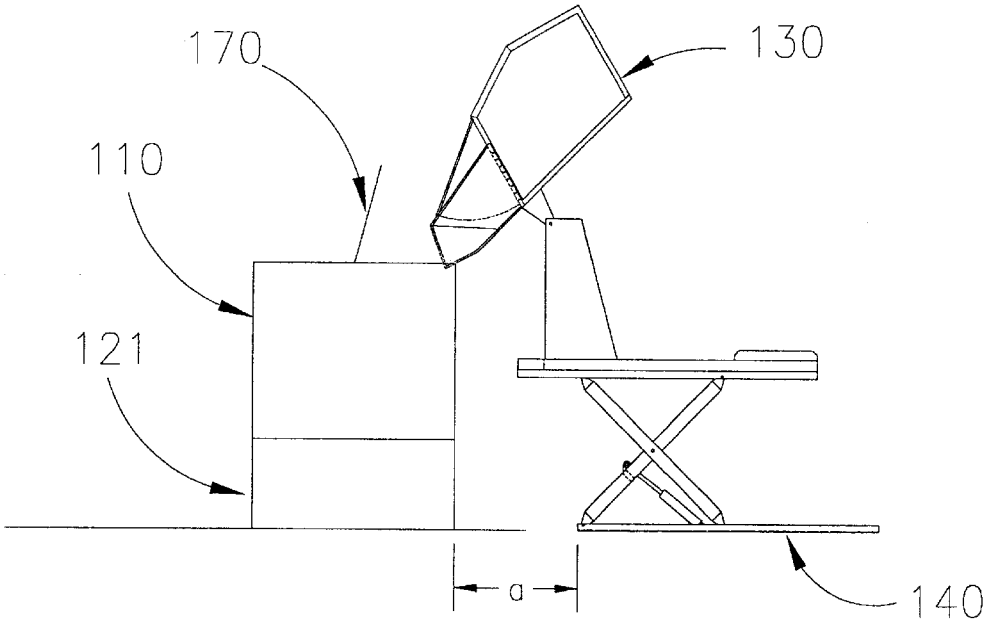
Figure 16:
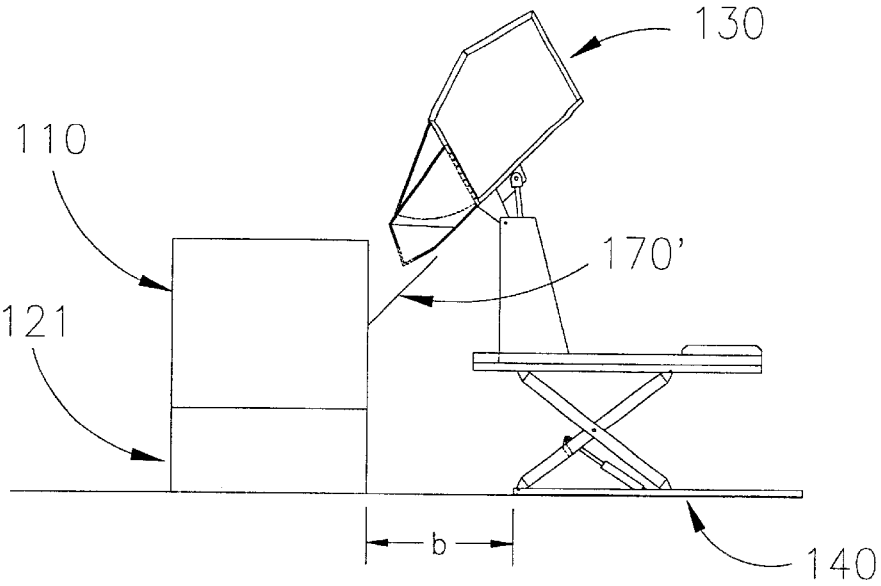
Figure 16:
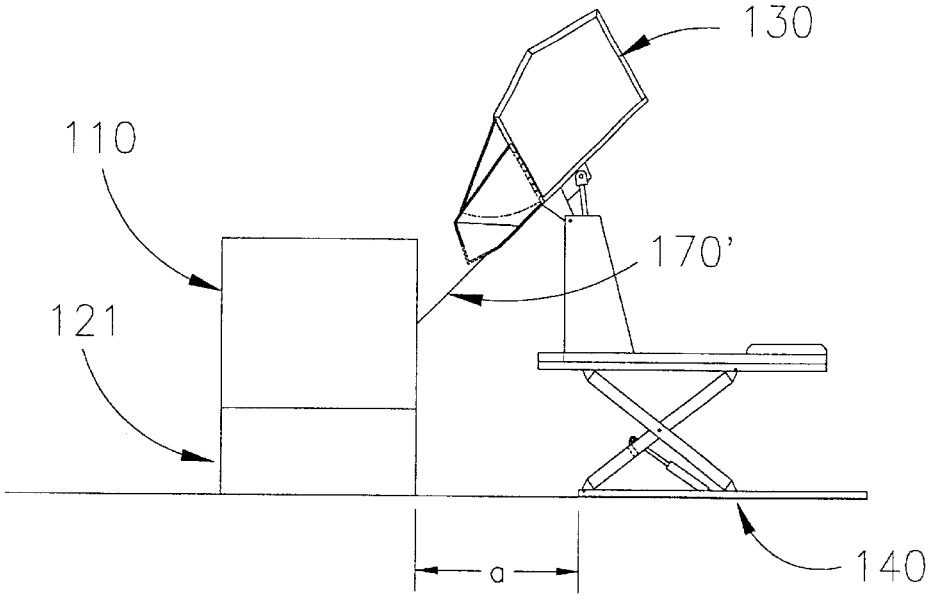
Figure 17:
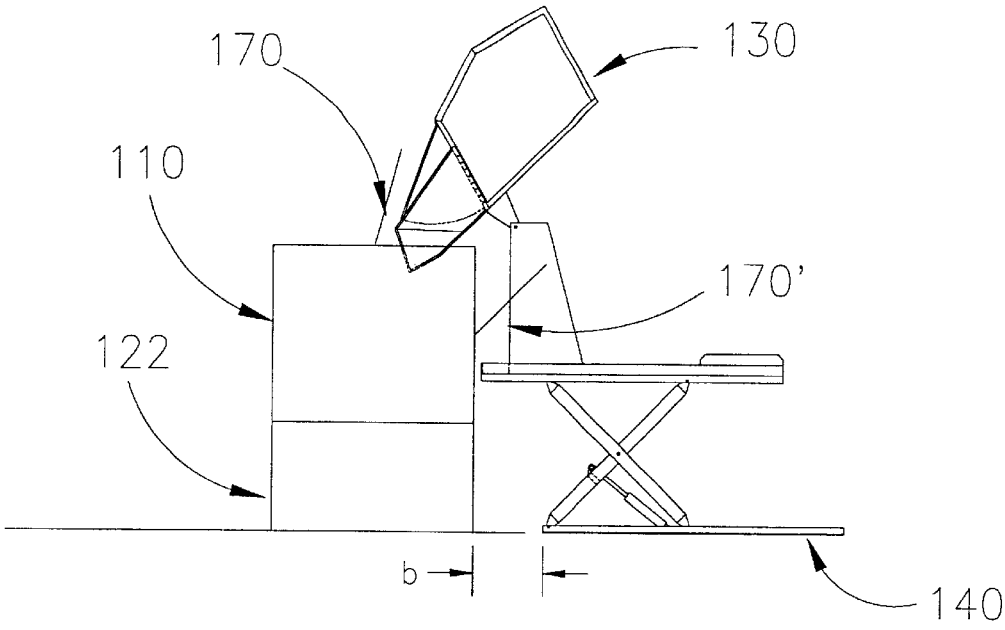
FIGS. 17A–F show the maximum and minimum distances for positioning a truck mounted hauling unit, A–B, when top and side chutes both are available on the hauling unit for use, C–D, when a top only chute is available, and E–F, when a side only chute is available.
Figure 17:
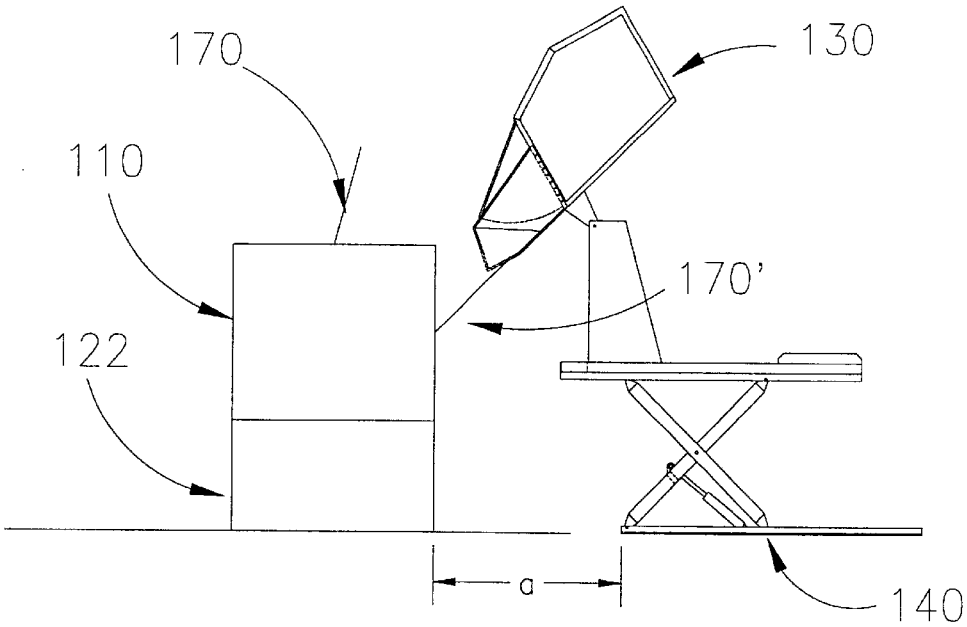
Figure 17:
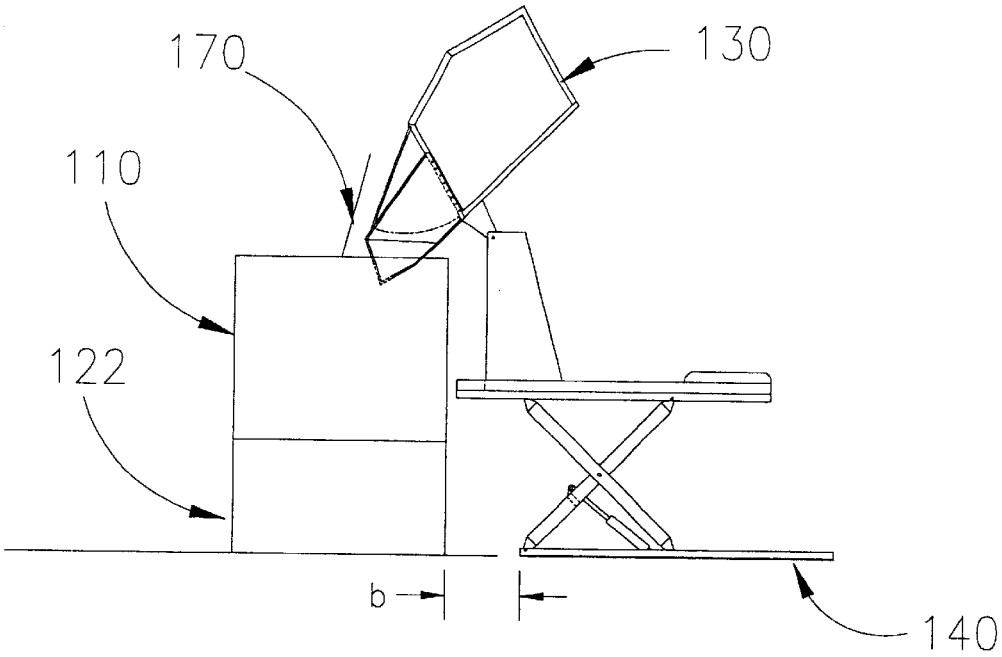
Figure 17:
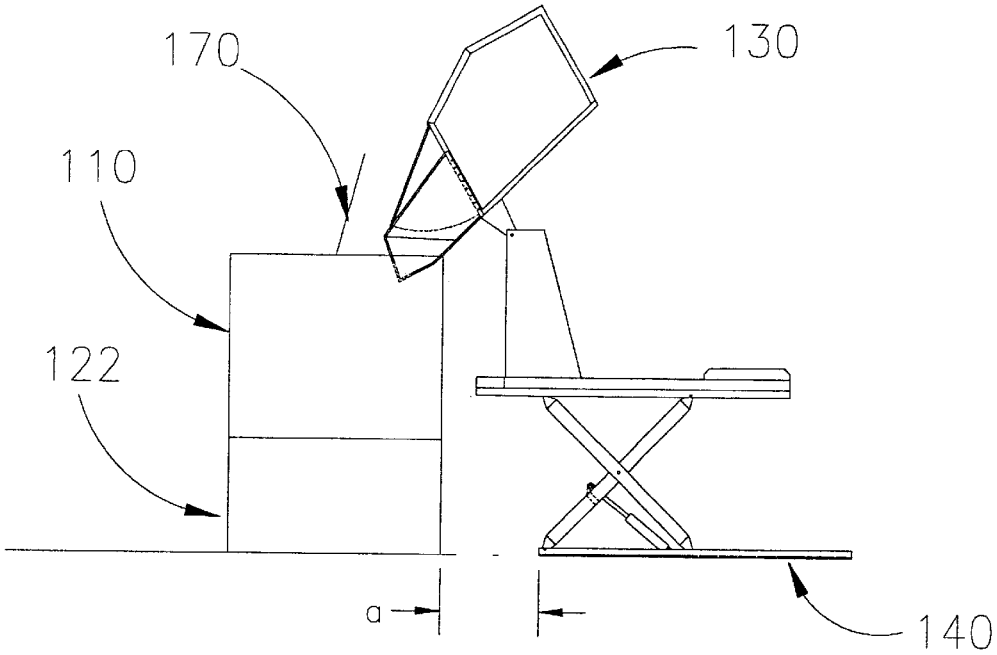
Figure 17:
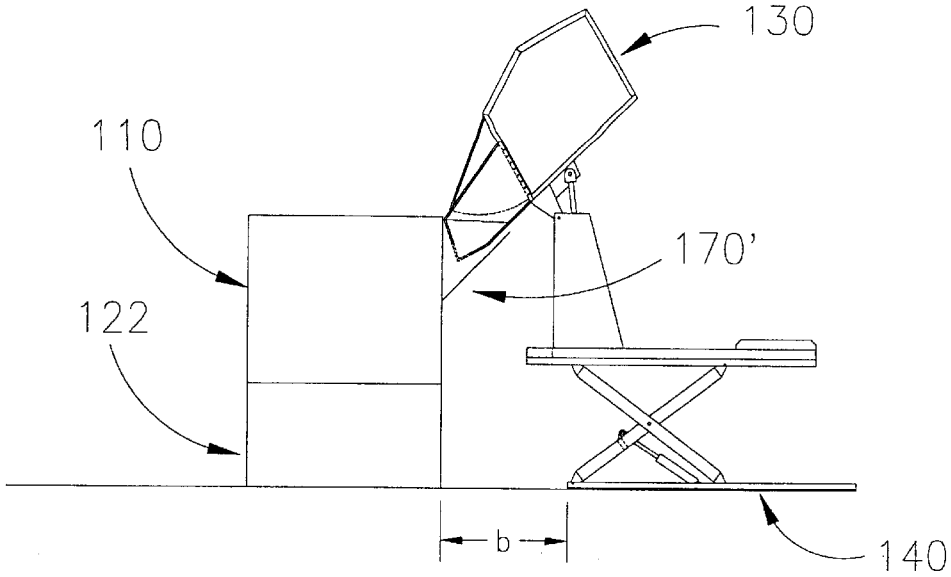
Figure 17:
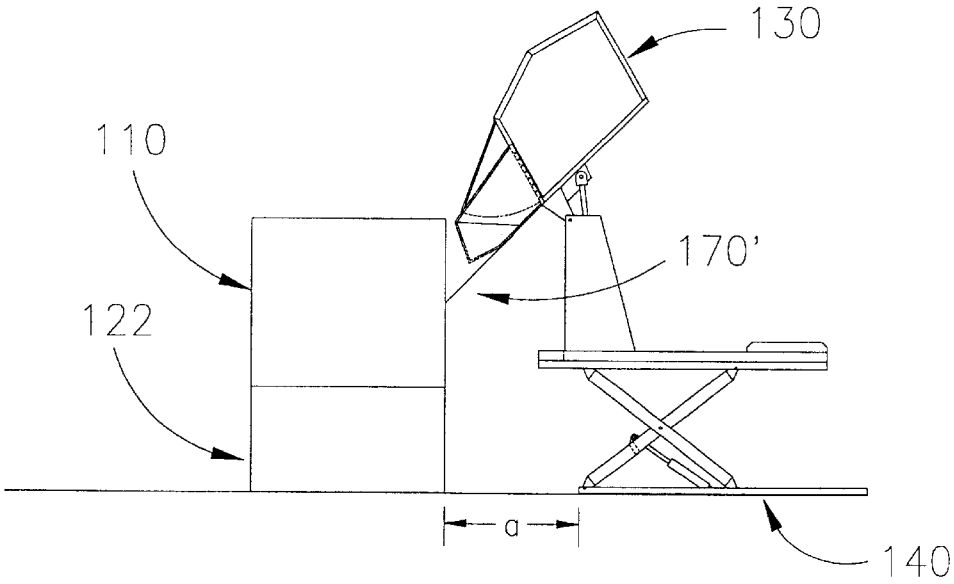

FIG. 17 is similar to FIG. 16 except that in FIG. 17, the transporting vehicle 120 is a truck chassis 122. The difference in the lateral distance, when the hauling unit 110 is mounted on a truck chassis 122, is that the hauling unit 110 will not be at the same height as when mounted on a trailer. In FIGS. 17A and 17B the hauling unit 110 is equipped with a top door 170 and a side door 171' for loading. With this arrangement the maximum distance "a" is approximately 70 inches and the minimum distance "b" is approximately 35 inches. FIGS. 17C and 17D show the minimum "b" and maximum "a" distance that the hauling unit 110 can be from the self-dumping bins 113 when the hauling unit 110 is equipped with a top load door 170 only. In view 17C the maximum distance "a" is approximately 37 inches and the minimum distance "b" is approximately 30 inches. Views 17E and 17F show the minimum "b" and maximum "a" distance when the hauling unit 110 is equipped with a side load door 170' only. The maximum distance "a" in FIG. 17E is approximately 56 inches and the minimum distance "b" is approximately 54 inches.

FIGS. 16 and 17 demonstrate that the greatest variance the hauling unit 110 can be from the self-dumping bin 130, and still be in the correct position, laterally, to unload, is when the hauling unit 110 is equipped with a top 170 and side 170' load door. The desirability of providing a large variance in lateral positioning of the hauling unit 110 should be apparent in that it would allow the self-dumping bin 130 to be unloaded, whether the transporting vehicle is a trailer 121 or a truck chassis 122, as less skill would be required to position the hauling unit 110. Such a variance would be advantageous for the operator as well as it would make dumping the bins easier.

The foregoing relates to preferred exemplary embodiments of the invention, it being understood that other variants and embodiments thereof are possible within the spirit and scope of the invention, the latter being defined by the appended claims.

We claim:

1. A refuse and recycling collecting system comprising a collecting unit mounted on a movable support means, a self dumping collecting bin which receives materials to be transferred to said collecting unit, said collecting unit includes an enclosed chamber for receiving collected materials, at least one door means which forms a chute means through which materials are received from said self dumping collecting bin and which is closable, said self dumping collecting bin including a lifting mechanism for lifting said bin to a dumping position from which the collected material is transferred to said collecting unit, said chute means includes cooperating baffle means which are disposed laterally on opposite sides of said at least one door means, each said baffle means comprises an inner part and an outer part which are hinged together, said inner part and said outer part being arranged so as to fold open when the at least one door means opens and fold closed when the at least one door means is closed.

2. A refuse and recycling collecting system as set forth in claim 1 in which, said self dumping collecting bin is lifted by a lift means which is either a hydraulic lift means or a mechanical lift means.

3. A refuse and recycling collecting system as set forth in claim 2 in which, said lift means is self contained in combination with said self dumping collecting bin.

4. A refuse and recycling collection system as set forth in claim 2 in which, said lift means is a hydraulic lift means, and said collecting unit includes a hydraulic pressure system and said hydraulic lift means of said self dumping bin is connected to said hydraulic pressure system of said collecting unit for lifting said self dumping bin hydraulically.

5. A refuse and recycling collection system as set forth in claim 4, in which said at least one door means is operated between a closed position and an open position by said hydraulic pressure system on said collecting unit.

6. A refuse and recycling collection system as set forth in claim 1, wherein said at least one door means comprises at least one door in a side wall of said collecting unit.

7. A refuse and recycling collection system as set forth in claim 1, wherein said at least one door means comprises at least one door in a top wall of said collecting unit.

8. A refuse and recycling collection system as set forth in claim 1 in which, alignment means are provided to allow for aligning said self-dumping bin and said collecting unit.

9. A refuse and recycling collection system as set forth in claim 8 in which, said alignment means comprises a T-handle mounted on either the bin or the collecting unit which is actuactable from a stored position unto an operative position extending between the bin and the collecting unit.

10. A refuse and recycling collection system as set forth in claim 8 in which, said alignment means comprises at least two photoelectric sensor transmitter/receiver units, one of the transmitter/ receiver units being mounted on the bin and the other of the transmitter/receiver units being mounted on said collecting unit.

11. A refuse and recycling collection system as set forth in claim 8 in which, said alignment means comprises indicating marks or bumps positioned on the ground proximate to the bin.

12. A refuse and recycling collecting system comprising:

a collecting unit mounted on a movable support means, a self dumping collecting bin which receives materials to be transferred to said collecting unit, said collecting unit includes an enclosed chamber for receiving collected materials, at least one door means which forms a chute means through which materials are received from said self dumping collecting bin and which is closable when materials are not being received, said self dumping collecting bin including a lifting mechanism for lifting said self dumping collecting bin to a dumping position relative to said collecting unit from which the collected material in the self dumping collecting bin is transferred to said collecting unit, wherein said at least one door means comprises at least one door in a top wall and at least one door in a side wall of said collecting unit which cooperate to open together to receive said collected materials.

13. A refuse and recycling collecting system as set forth in claim 12 in which, said self dumping collecting bin is lifted by a lift means which is either a hydraulic lift means or a mechanical lift means.

14. A refuse and recycling collection system as set forth in claim 13 in which, said lift means is a hydraulic lift means, and said collecting unit includes a hydraulic pressure system, and, said hydraulic lift means of said self dumping bin is connected to said hydraulic pressure system of said collecting unit for lifting said self dumping bin hydraulically.

* * * * *

UNITED STATES PATENT AND TRADEMARK OFFICE

CERTIFICATE OF CORRECTION

PATENT NO. : 6,309,164 B1
DATED : October 30, 2001
INVENTOR(S) : Jamie Val Holder It is certified that error appears in the above-identified patent and that said Letters Patent is hereby corrected as shown below:

Title page,
Item [73], should read as follows:
-- [73] Assignee: HOL-MAC Corporation, Bay Springs, MS (USA) --

Signed and Sealed this

Fifth Day of March, 2002

*Attest:*

*Attesting Officer*

JAMES E. ROGAN
*Director of the United States Patent and Trademark Office*